US009864285B2

(12) United States Patent
Nishi et al.

(10) Patent No.: US 9,864,285 B2
(45) Date of Patent: Jan. 9, 2018

(54) ELECTROPHOTOGRAPHIC PHOTOSENSITIVE MEMBER, PROCESS CARTRIDGE, AND ELECTROPHOTOGRAPHIC APPARATUS

(71) Applicant: CANON KABUSHIKI KAISHA, Tokyo (JP)

(72) Inventors: Masashi Nishi, Susono (JP); Kunihiko Sekido, Suntou-gun (JP); Michiyo Sekiya, Atami (JP); Kei Tagami, Yokohama (JP); Yuki Yamamoto, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/184,073

(22) Filed: Jun. 16, 2016

(65) Prior Publication Data

US 2016/0378000 A1 Dec. 29, 2016

(30) Foreign Application Priority Data

Jun. 25, 2015 (JP) ..... 2015-127983

(51) Int. Cl.
*G03G 5/14* (2006.01)
*G03G 5/06* (2006.01)
(Continued)

(52) U.S. Cl.
CPC ..... *G03G 5/142* (2013.01); *G03G 5/0696* (2013.01); *G03G 5/071* (2013.01); *G03G 15/75* (2013.01); *G03G 21/18* (2013.01)

(58) Field of Classification Search
CPC ..... G03G 5/142
See application file for complete search history.

(56) References Cited

U.S. PATENT DOCUMENTS 4,442,193 A 4/1984 Chen et al.
4,992,348 A 2/1991 Hayakawa et al.
(Continued)

FOREIGN PATENT DOCUMENTS

JP 04273247 A * 9/1992
JP 2003330209 11/2003

OTHER PUBLICATIONS

U.S. Appl. No. 14/656,272, Akihiro Maruyama, filed Mar. 12, 2015.
(Continued)

*Primary Examiner* — Christopher D Rodee
(74) *Attorney, Agent, or Firm* — Fitzpatrick Cella Harper and Scinto

(57) ABSTRACT

Provided is an electrophotographic photosensitive member comprising a support, an intermediate layer formed on the support, a charge generating layer formed directly on the intermediate layer, and a charge transporting layer formed on the charge generating layer, in which the intermediate layer contains a compound represented by the formula (1).

(1)

7 Claims, 2 Drawing Sheets

(51) Int. Cl.

| | |
|---|---|
| ***G03G 5/07*** | (2006.01) |
| ***G03G 21/18*** | (2006.01) |
| ***G03G 15/00*** | (2006.01) |

(56) References Cited

U.S. PATENT DOCUMENTS

| | | | | |
|---|---|---|---|---|
| 4,992,349 | A | 2/1991 | Chen et al. | |
| 5,455,135 | A | 10/1995 | Maruyama et al. | |
| 5,468,583 | A | 11/1995 | Gruenbaum et al. | |
| 5,604,061 | A | 2/1997 | Sekido et al. | |
| 5,693,443 | A | 12/1997 | Nakamura et al. | |
| 6,110,628 | A | 8/2000 | Sekiya et al. | |
| 6,228,546 | B1 | 5/2001 | Kashizaki et al. | |
| 6,372,397 | B1 | 4/2002 | Maruyama et al. | |
| 6,436,597 | B2 | 8/2002 | Maruyama et al. | |
| 6,664,014 | B1 | 12/2003 | Kikuchi et al. | |
| 6,866,977 | B2 * | 3/2005 | Sorriero | C08G 73/1082 430/64 |
| 7,141,341 | B2 | 11/2006 | Sekido et al. | |
| 7,378,205 | B2 | 5/2008 | Sekiya et al. | |
| 8,343,699 | B2 | 1/2013 | Nagasaka et al. | |
| 8,465,889 | B2 | 6/2013 | Sekido et al. | |
| 8,524,430 | B2 | 9/2013 | Takagi et al. | |
| 8,546,050 | B2 | 10/2013 | Maruyama et al. | |
| 8,632,931 | B2 | 1/2014 | Sekido et al. | |
| 8,795,936 | B2 * | 8/2014 | Sekido | G03G 5/0607 399/111 |
| 9,029,054 | B2 | 5/2015 | Okuda et al. | |
| 9,034,545 | B2 | 5/2015 | Maruyama et al. | |
| 9,063,505 | B2 | 6/2015 | Sekiya et al. | |
| 9,069,267 | B2 | 6/2015 | Kaku et al. | |
| 9,164,406 | B2 | 10/2015 | Nishi et al. | |
| 9,207,550 | B2 | 12/2015 | Okuda et al. | |
| 9,235,144 | B2 | 1/2016 | Yamamoto et al. | |
| 9,274,442 | B2 | 3/2016 | Sato et al. | |
| 9,280,072 | B2 | 3/2016 | Ogaki et al. | |
| 9,335,645 | B2 | 5/2016 | Tagami et al. | |
| 2007/0026332 | A1 * | 2/2007 | Ferrar | G03G 5/102 430/64 |
| 2009/0035677 | A1 * | 2/2009 | Ferrar | G03G 5/0571 430/64 |
| 2014/0004452 | A1 * | 1/2014 | Sekiya | G03G 15/00 430/56 |
| 2014/0154618 | A1 | 6/2014 | Maruyama et al. | |
| 2015/0099218 | A1 * | 4/2015 | Murakami | G03G 5/144 430/65 |
| 2015/0185630 | A1 * | 7/2015 | Ito | G03G 5/0575 430/56 |
| 2015/0185632 | A1 | 7/2015 | Sekido et al. | |
| 2015/0185634 | A1 | 7/2015 | Sekiya et al. | |
| 2015/0185636 | A1 * | 7/2015 | Sekiya | G03G 5/142 430/56 |
| 2015/0185637 | A1 | 7/2015 | Nishi et al. | |
| 2015/0185638 | A1 * | 7/2015 | Nakamura | G03G 5/076 430/56 |
| 2015/0277248 | A1 | 10/2015 | Maruyama et al. | |
| 2016/0116853 | A1 | 4/2016 | Sekiya et al. | |
| 2016/0139556 | A1 | 5/2016 | Yamamoto et al. | |
| 2016/0187794 | A1 | 6/2016 | Okuda et al. | |
| 2016/0216618 | A1 | 7/2016 | Sakuma et al. | |

OTHER PUBLICATIONS

U.S. Appl. No. 15/077,209, Kunihiko Sekido, filed Mar. 22, 2016.
U.S. Appl. No. 15/132,227, Yohei Miyauchi, filed Apr. 18, 2016.
U.S. Appl. No. 15/169,418, Masashi Nishi, filed May 31, 2016.
U.S. Appl. No. 15/184,100, Masashi Nishi, filed Jun. 16, 2016.
U.S. Appl. No. 15/186,749, Kunihiko Sekido, filed Jun. 20, 2016.
"Crosslinking Agent Handbook" edited by Shinzo Yamashita and Tosuke Kaneko, and published by Taiseisha Ltd. (1981).
Chemistry of Materials, vol. 19, No. 11, 2703-2705 (2007).

* cited by examiner

ELECTROPHOTOGRAPHIC PHOTOSENSITIVE MEMBER, PROCESS CARTRIDGE, AND ELECTROPHOTOGRAPHIC APPARATUS

BACKGROUND OF THE INVENTION

Field of the Invention

The present invention relates to an electrophotographic photosensitive member, a process cartridge, and an electrophotographic apparatus.

Description of the Related Art

At present, an electrophotographic photosensitive member containing an organic photoconductive material (organic electrophotographic photosensitive member, hereinafter sometimes referred to as "photosensitive member") is in the mainstream of an electrophotographic photosensitive member to be mounted onto a process cartridge or an electrophotographic apparatus. The electrophotographic photosensitive member using the organic photoconductive material has advantages, such as a pollution-free property, high productivity, and the ease of material design.

The electrophotographic photosensitive member generally includes a support and a photosensitive layer formed on the support. In addition, the photosensitive layer is generally a laminated photosensitive layer obtained by laminating a charge generating layer and a charge transporting layer in the stated order from a support side. Further, an intermediate layer is often arranged between the support and the photosensitive layer for the purpose of suppressing the injection of charge from the support side to a photosensitive layer side to suppress the occurrence of an image failure, such as a black spot. In addition, an undercoat layer, such as an electroconductive layer, is arranged between the support and the intermediate layer in some cases.

In recent years, a charge generating material having higher sensitivity has been used. However, a rise in sensitivity of the charge generating material involves a problem in that the quantity of charge to be generated increases and hence the charge is liable to remain in the charge generating layer.

A technology involving incorporating an electron transporting material into the intermediate layer to smoothen the transfer of an electron from a charge generating layer side to the support side has been known as a technology of suppressing such remaining of the charge in the charge generating layer. In addition, in order that the electron transporting material may not be eluted at the time of the formation of the charge generating layer to be formed on the intermediate layer, when the electron transporting material is incorporated into the intermediate layer, a technology involving using a curable material, which is hardly soluble in the solvent of a coating liquid for a charge generating layer, in the intermediate layer has been known. In Japanese Patent Application Laid-Open No. 2003-330209, there is a disclosure of the incorporation of a cured product of an electron transporting material having a nonhydrolyzable polymerizable functional group into the intermediate layer.

However, the incorporation of the cured product into the intermediate layer reduces adhesiveness at an interface between the intermediate layer and the charge generating layer, and hence a ghost phenomenon is liable to occur in some cases. Accordingly, the adhesiveness is susceptible to improvement. Here, the ghost phenomenon is specifically the so-called positive ghost phenomenon in which the density of only a portion irradiated with light at the time of a forward rotation in an output image increases.

SUMMARY OF THE INVENTION

An object of the present invention is to provide an electrophotographic photosensitive member that is improved in adhesiveness at an interface between an intermediate layer and a charge generating layer, and is reduced in ghost phenomenon, and a process cartridge and an electrophotographic apparatus each including the electrophotographic photosensitive member.

According to one embodiment of the present invention, there is provided an electrophotographic photosensitive member, including:

a support;

an intermediate layer formed on the support;

a charge generating layer formed directly on the intermediate layer; and a charge transporting layer formed on the charge generating layer, in which:

the intermediate layer contains a polymer of a composition containing a compound represented by the formula (1);

when an averaged sectional difference of elevation in a calculated length range of from 0.1 μm or more to 100 μm or less in a surface of the intermediate layer on a charge generating layer side is measured, in a calculated length range of from 0.5 times or more to 1.5 times or less of a calculated length at which a maximum of the averaged sectional difference of elevation (Rmk, max) is expressed, a value for the averaged sectional difference of elevation (Rmk) is 0.05 μm or more; and the charge generating layer contains a phthalocyanine pigment and a resin.

(1)

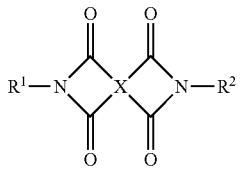

In the formula (1), $R^1$ represents an alkyl group having 1 to 6 carbon atoms in a main chain thereof, the alkyl group having 2 or more polymerizable functional groups, a group derived by substituting at least one $CH_2$ in a main chain of an alkyl group having 3 to 6 carbon atoms in the main chain, the alkyl group having 2 or more polymerizable functional groups, with an oxygen atom, or a group derived by substituting at least one $CH_2$ in a main chain of an alkyl group having 3 to 6 carbon atoms in the main chain, the alkyl group having 2 or more polymerizable functional groups, with $NR^{17}$, the polymerizable functional groups each include a hydroxy group, a thiol group, an amino group, or a carboxyl group, and $R^{17}$ represents a hydrogen atom or an alkyl group having 1 to 4 carbon atoms in a main chain thereof.

$R^2$ represents a substituted or unsubstituted alkyl group having 1 to 6 carbon atoms in a main chain thereof, a group derived by substituting at least one $CH_2$ in a main chain of a substituted or unsubstituted alkyl group having 3 to 6 carbon atoms in the main chain with an oxygen atom, a group derived by substituting at least one $CH_2$ in a main chain of a substituted or unsubstituted alkyl group having 3 to 6 carbon atoms in the main chain with $NR^{18}$, a group derived by substituting at least one $C_2H_4$ in a main chain of a substituted or unsubstituted alkyl group having 3 to 6 carbon atoms in the main chain with COO, or a substituted or unsubstituted aryl group, and $R^{18}$ represents a hydrogen atom or an alkyl group having 1 to 4 carbon atoms in a main chain thereof.

A substituent of each of the alkyl group, the group derived by substituting at least one $CH_2$ in the main chain of the alkyl group with an oxygen atom, the group derived by substituting at least one $CH_2$ in the main chain of the alkyl group with $NR^{17}$, the group derived by substituting at least one $CH_2$ in the main chain of the alkyl group with $NR^{18}$, and the group derived by substituting at least one $C_2H_4$ in the main chain of the alkyl group with COO includes an alkyl group having 1 to 5 carbon atoms, a benzyl group, an alkoxycarbonyl group, or a phenyl group.

A substituent of the aryl group includes a halogen atom, a cyano group, a nitro group, a methyl group, an ethyl group, an isopropyl group, a n-propyl group, a n-butyl group, an acyl group, an alkoxy group, an alkoxycarbonyl group, or an aminoalkoxy group.

X represents one structure selected from the formulae (X1), (X2), and (X3).

(X1)

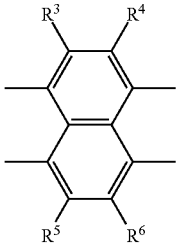

(X2)

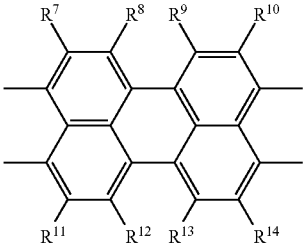

(X3)

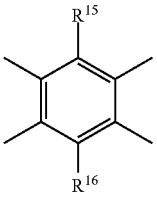

In the formulae (X1) to (X3), $R^3$ to $R^{16}$ each independently represent a hydrogen atom, a halogen atom, a cyano group, a nitro group, a substituted or unsubstituted alkyl group having 1 to 6 carbon atoms in a main chain thereof, or a substituted or unsubstituted aryl group.

According to one embodiment of the present invention, there is provided a process cartridge, including: the electrophotographic photosensitive member; and at least one unit selected from the group consisting of a charging unit, a developing unit, a transferring unit, and a cleaning unit, the process cartridge integrally supporting the electrophotographic photosensitive member and the at least one unit, the process cartridge being removably mounted onto a main body of an electrophotographic apparatus.

According to one embodiment of the present invention, there is provided an electrophotographic apparatus, including: the electrophotographic photosensitive member; a charging unit; an exposing unit; a developing unit; and a transferring unit.

According to the present invention, the electrophotographic photosensitive member that is improved in adhesiveness at the interface between the intermediate layer and the charge generating layer, and is reduced in ghost phenomenon, and the process cartridge and the electrophotographic apparatus each including the electrophotographic photosensitive member can be provided.

Further features of the present invention will become apparent from the following description of exemplary embodiments with reference to the attached drawings.

DESCRIPTION OF THE EMBODIMENTS

Figure 1A:
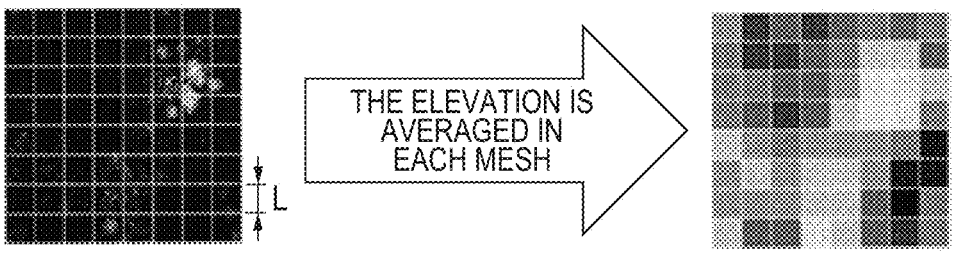
FIG. 1A is a view for illustrating the mesh division of three-dimensional surface profile data at the time of the calculation of an Rmk(L).

Preferred embodiments of the present invention will now be described in detail in accordance with the accompanying drawings.

An electrophotographic photosensitive member of the present invention is an electrophotographic photosensitive member including: a support; an intermediate layer formed on the support; a charge generating layer formed directly on the intermediate layer, and a charge transporting layer formed on the charge generating layer, in which: the intermediate layer contains a polymer of a composition containing a compound represented by the formula (1); a surface of the intermediate layer on a charge generating layer side has such a surface profile that in the calculated length range of from 0.5 times or more to 1.5 times or less of the calculated length at which the maximum of an averaged sectional difference of elevation (Rmk,max) is expressed in the calculated length range of from 0.1 μm or more to 100 μm or less, a value for the averaged sectional difference of elevation (Rmk) is 0.05 μm or more; and the charge generating layer contains a phthalocyanine pigment and a resin.

(1)

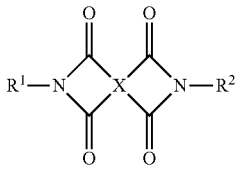

In the formula (1), $R^1$ represents an alkyl group having 1 to 6 carbon atoms in a main chain thereof, the alkyl group having 2 or more polymerizable functional groups, a group derived by substituting at least one $CH_2$ in a main chain of an alkyl group having 3 to 6 carbon atoms in the main chain, the alkyl group having 2 or more polymerizable functional groups, with an oxygen atom, or a group derived by substituting at least one $CH_2$ in a main chain of an alkyl group having 3 to 6 carbon atoms in the main chain, the alkyl group having 2 or more polymerizable functional groups, with $NR^{17}$, the polymerizable functional groups are each a hydroxy group, a thiol group, an amino group, or a carboxyl group, and $R^{17}$ represents a hydrogen atom or an alkyl group having 1 to 4 carbon atoms in a main chain thereof. However, in the group derived by substituting at least one $CH_2$ in the main chain of the alkyl group with an oxygen atom or $NR^{17}$, none of the oxygen atom and the $NR^{17}$ is directly bonded to the nitrogen atom to which $R^1$ is bonded.

In the formula (1), $R^2$ represents a substituted or unsubstituted alkyl group having 1 to 6 carbon atoms in a main chain thereof, a group derived by substituting at least one $CH_2$ in a main chain of a substituted or unsubstituted alkyl group having 3 to 6 carbon atoms in the main chain with an oxygen atom, a group derived by substituting at least one $CH_2$ in a main chain of a substituted or unsubstituted alkyl group having 3 to 6 carbon atoms in the main chain with $NR^{18}$, or a substituted or unsubstituted aryl group, and $R^{18}$ represents a hydrogen atom or an alkyl group having 1 to 4 carbon atoms in a main chain thereof. However, in the group derived by substituting at least one $CH_2$ in the main chain of the alkyl group with an oxygen atom or $NR^{18}$, none of the oxygen atom and the $NR^{18}$ is directly bonded to the nitrogen atom to which $R^2$ is bonded.

In the formula (1), a substituent of each of the alkyl group, the group derived by substituting at least one $CH_2$ in the main chain of the alkyl group with an oxygen atom, the group derived by substituting at least one $CH_2$ in the main chain of the alkyl group with $NR^{17}$, and the group derived by substituting at least one $CH_2$ in the main chain of the alkyl group with $NR^{18}$ is an alkyl group having 1 to 5 carbon atoms, an alkoxycarbonyl group, a benzyl group, or a phenyl group.

In the formula (1), a substituent of the aryl group is a halogen atom, a cyano group, a nitro group, a methyl group, an ethyl group, an isopropyl group, a n-propyl group, a n-butyl group, an acyl group, an alkoxy group, an alkoxycarbonyl group, or an aminoalkoxy group.

In the formula (1), X represents one structure selected from the formulae (X1), (X2), and (X3).

(X1)

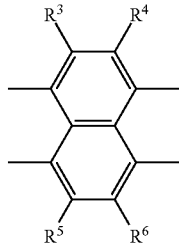

(X2)

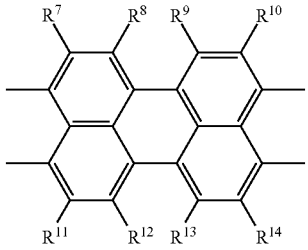

(X3)

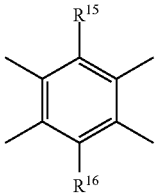

In the formulae (X1), (X2), and (X3), $R^3$ to $R^{16}$ each independently represent a hydrogen atom, a halogen atom, a cyano group, a nitro group, a substituted or unsubstituted alkyl group having 1 to 6 carbon atoms in a main chain thereof, or a substituted or unsubstituted aryl group.

In the compound represented by the formula (1), the alkyl group having 1 to 6 carbon atoms in a main chain thereof serving as any one of $R^1$, $R^2$, and $R^3$ to $R^{16}$ is a linear alkyl group or a branched alkyl group, and examples thereof include, but not limited to, a methyl group, an ethyl group, a propyl group, an isopropyl group, a n-butyl group, a s-butyl group, a t-butyl group, an isobutyl group, a n-pentyl group, a pentan-2-yl group, a pentan-3-yl group, a 2-methylbutyl group, a 2-methylbutan-2-yl group, a 3-methylbutan-2-yl group, a 3-methylbutyl group, a 2,2-dimethylpropyl group, a n-hexyl group, a hexan-2-yl group, a hexan-3-yl group, a 2-methylpentyl group, a 2-methylpentan-2-yl group, a 2-methylpentan-3-yl group, a 4-methylpentan-2-yl group, a 3-methylpentyl group, a 4-methylpentyl group, a 3-methylpentan-2-yl group, a 3-methylpentan-3-yl group, a 2,2-dimethylbutyl group, a 3,3-dimethylbutan-2-yl group, a 3,3-dimethylbutyl group, a 2,3-dimethylbutyl group, a 2,3-dimethylbutan-2-yl group, and a 3,3-dimethylbutan-2-yl group.

In addition, in the compound represented by the formula (1), the alkyl group having 1 to 4 carbon atoms in a main chain thereof serving as any one of $R^{17}$ and $R^{18}$ is a linear alkyl group or a branched alkyl group. Examples thereof include a methyl group, an ethyl group, a propyl group, an isopropyl group, a n-butyl group, a s-butyl group, a t-butyl group, and an isobutyl group.

In the compound represented by the formula (1), examples of the group derived by substituting at least one $CH_2$ in the main chain of the alkyl group having 3 to 6 carbon atoms with an oxygen atom serving as any one of $R^1$ and $R^2$ include a methoxymethyl group, an ethoxymethyl group, a 1-methoxyethyl group, a 2-methoxyethyl group, a 3-methoxypropyl group, a 2-ethoxyethyl group, a n-propoxymethyl group, an isopropoxymethyl group, a 1-methyl-2-methoxyethyl group, a 1-ethoxyethyl group, a 2-methoxypropyl group, a 1-methyl-1-methoxyethyl group, a 1-methoxypropyl group, a 4-methoxybutyl group, a 3-ethoxypropyl group, a 2-n-propoxyethyl group, a n-butoxymethyl group, a 1-methyl-3-methoxypropyl group, a 1-methyl-2-ethoxyethyl group, a 1-n-propoxyethyl group, a 2-methyl-3-methoxypropyl group, a 2-ethoxypropyl group, a 3-methoxybutyl group, a s-butoxymethyl group, a 1-isopropoxyethyl group, a 2-isopropoxyethyl group, an isobutoxymethyl group, a 1,1-dimethyl-1-ethoxymethyl group, a 1,1-dimethyl-1-methoxyethyl group, a 1,2-dimethyl-2-methoxyethyl group, a 2,2-dimethyl-2-methoxyethyl group, a t-butoxymethyl group, a 1-methoxybutyl group, a 2-ethoxypropyl group, a 1-methoxymethylpropyl group, a 1-methyl-1-methoxypropyl group, a 2-methyl-1-methoxypropyl group, a methoxymethoxymethyl group, a 2-(methoxymethoxy)ethyl group, a (1-methoxyethoxy)methyl group, a (2-methoxyethoxy)methyl group, an ethoxymethoxymethyl group, a 1-(methoxymethoxy)ethyl group, a dimethoxymethyl group, an ethoxymethoxymethyl group, a 1,1-dimethoxyethyl group, and a 1,2-dimethoxyethyl group.

In the compound represented by the formula (1), examples of the group derived by substituting at least one $CH_2$ in the main chain of the alkyl group having 3 to 6 carbon atoms with $NR^{17}$ or $NR^{18}$ (hereinafter sometimes represented as "$NR^{17/18}$") serving as any one of $R^1$ and $R^2$ include a (methyl$R^{17/18}$amino)methyl group, an (ethyl$R^{17/18}$amino)methyl group, a 1-(methyl$R^{17/18}$amino)ethyl group, a 2-(methyl$R^{17/18}$amino)ethyl group, a 3-(methyl$R^{17/18}$amino)propyl group, a 2-(ethyl$R^{17/18}$amino)ethyl group, a (n-propyl$R^{17/18}$amino)methyl group, an (isopropyl$R^{17/18}$amino)methyl group, a 1-methyl-2-(methyl$R^{17/18}$amino)ethyl group, a 1-(ethyl$R^{17/18}$amino)ethyl group, a 2-(methyl$R^{17/18}$amino)propyl group, a 1-methyl-1-(methyl$R^{17/18}$amino)ethyl group, a 1-(methyl$R^{17/18}$amino)propyl group, a 4-(methyl$R^{17/18}$amino)butyl group, a 3-(ethyl$R^{17/18}$amino)propyl group, a 2-(n-propyl$R^{17/18}$amino)ethyl group, a (n-butyl$R^{17/18}$amino)methyl group, a 1-methyl-3-(methyl$R^{17/18}$amino)propyl group, a 1-methyl-2-(ethyl$R^{17/18}$amino)ethyl group, a 1-(n-propyl$R^{17/18}$amino)ethyl group, a 2-methyl-3-(methyl$R^{17/18}$amino)propyl group, a 2-(ethyl$R^{17/18}$amino)propyl group, a 3-(methyl$R^{17/18}$amino)butyl group, a (s-butyl$R^{17/18}$amino)methyl group, a 1-(isopropyl$R^{17/18}$amino)ethyl group, a 2-(isopropyl$R^{17/18}$amino)ethyl group, an (isobutyl$R^{17/18}$amino)methyl group, a 1,1-dimethyl-1-(ethyl$R^{17/18}$amino)methyl group, a 1,1-dimethyl-1-(methyl$R^{17/18}$amino)ethyl group, a 1,2-dimethyl-2-(methyl$R^{17/18}$amino)ethyl group, a 2,2-dimethyl-2-(methyl$R^{17/18}$amino)ethyl group, a (t-butyl$R^{17/18}$amino)methyl group, a 1-(methyl$R^{17/18}$amino)butyl group, a 2-(ethyl$R^{17/18}$amino)propyl group, a 1-(methyl$R^{17/18}$amino)methylpropyl group, a 1-methyl-1-(methyl$R^{17/18}$amino)propyl group, a 2-methyl-1-(methyl$R^{17/18}$amino)propyl group, a [(methyl$R^{17/18}$aminomethyl)$R^{17/18}$amino]methyl group, a 2-[(methyl$R^{17/18}$aminomethyl)$R^{17/18}$amino)]ethyl group, a [1-(methyl$R^{17/18}$aminoethyl)$R^{17/18}$amino]methyl group, a [2-(methyl$R^{17/18}$aminoethyl)$R^{17/18}$amino]methyl group, an [(ethyl$R^{17/18}$aminomethyl)$R^{17/18}$amino]methyl group, a 1-[(methyl$R^{17/18}$aminomethyl)$R^{17/18}$amino]ethyl group, a di(methyl$R^{17/18}$amino)methyl group, an [ethyl$R^{17/18}$aminomethyl)$R^{17/18}$ amino]methyl group, a 1,1-di(methyl$R^{17/18}$amino)ethyl group, and a 1,2-di(methyl$R^{17/18}$amino)ethyl group.

Examples of the substituent of each of the alkyl group having 1 to 6 carbon atoms in a main chain thereof, the alkyl group having 1 to 4 carbon atoms in a main chain thereof, the group derived by substituting at least one $CH_2$ in the main chain of the alkyl group having 3 to 6 carbon atoms in the main chain with an oxygen atom, and the group derived by substituting at least one $CH_2$ in the main chain of the alkyl group having 3 to 6 carbon atoms in the main chain with $NR^{17}$ or $NR^{18}$ include, but not limited to, an alkyl group, an alkoxycarbonyl group, a benzyl group, and a phenyl group. Examples of the alkyl group serving as the substituent include the same groups as the alkyl group having 1 to 6 carbon atoms in a main chain thereof or the alkyl group having 1 to 4 carbon atoms in a main chain thereof. In addition, the alkoxycarbonyl group serving as the substituent is a group having bonded thereto the alkyl group serving as the substituent through an oxycarbonyl (OCO) group. Further, the substituent of the alkyl group having 1 to 6 carbon atoms in a main chain thereof, the alkyl group having 1 to 4 carbon atoms in a main chain thereof, the group derived by substituting at least one $CH_2$ in the main chain of the alkyl group having 3 to 6 carbon atoms in the main chain with an oxygen atom, or the group derived by substituting at least one $CH_2$ in the main chain of the alkyl group having 3 to 6 carbon atoms in the main chain with $NR^{17}$ or $NR^{18}$ may be substituted with one of those substituents alone, or may be simultaneously substituted with two or more of the substituents. Alternatively, the substituents may each be further substituted with any other of the substituents.

In the compound represented by the formula (1), examples of the aryl group serving as any one of $R^2$ and $R^3$ to $R^{16}$ include, but not limited to, a phenyl group, a naphthyl group, a fluorenyl group, an anthranyl group, and a phenanthrenyl group.

In the compound represented by the formula (1), examples of the substituent of the aryl group include, but not limited to, a halogen atom, a cyano group, a nitro group, a methyl group, an ethyl group, an isopropyl group, a n-propyl group, a n-butyl group, an acyl group, an alkoxy group, an alkoxycarbonyl group, and an aminoalkoxy group. Examples of the halogen atom serving as the substituent can include fluorine, chlorine, bromine, and iodine. In addition, the acyl group serving as the substituent is a group having bonded thereto a methyl group, an ethyl group, an isopropyl group, a n-propyl group, or a n-butyl group through a carbonyl group. Further, the alkoxy group serving as the substituent is a group having bonded thereto a methyl group, an ethyl group, an isopropyl group, a n-propyl group, or a n-butyl group through an oxygen atom. Further, the alkoxycarbonyl group serving as the substituent is a group having bonded thereto a methyl group, an ethyl group, an isopropyl group, a n-propyl group, or a n-butyl group through an oxycarbonyl (OCO) group. Further, the aminoalkoxy group serving as the substituent is a group obtained by substituting the alkoxy group with one or two or more amino groups. The aryl group may be substituted with one of those substituents alone, or may be simultaneously substituted with two or more of the substituents. The methyl group, the ethyl group, the isopropyl group, the n-propyl group, the n-butyl group, the acyl group, the alkoxy group, the alkoxycarbonyl group, or the aminoalkoxy group may be further substituted with any other halogen atom, cyano group, nitro group, methyl group, ethyl group, isopropyl group, n-propyl group, n-butyl group, acyl group, alkoxy group, or alkoxycarbonyl group.

Here, the dependence of the averaged sectional difference of elevation Rmk on a calculated length L is described. The parameter is calculated by the following procedures (1) to (5). After the measurement of three-dimensional surface profile data z(x,y) on a support or a layer of interest, (1) the resultant surface profile data is divided into meshes each having a length of one side of L (see the left figure of FIG. 1A),
(2) the elevations z(x,y) are averaged in each mesh having a length of one side of L (see the right figure of FIG. 1A),
(3) in each mesh, sectional differences of elevation are calculated from differences of elevation from the surrounding meshes,
(4) the resultant sectional differences of elevation are averaged over all the meshes, and the resultant value is called the averaged sectional difference of elevation Rmk, and
(5) the dependence of the averaged sectional difference of elevation Rmk on the calculated length L, i.e., a function Rmk(L) is obtained by repeating the procedures (1) to (4) while changing the L.

The Rmk(L) thus obtained is graphed so that the axis of abscissa may indicate the logarithm of the calculated length L (μm) and the axis of ordinate may indicate the averaged sectional difference of elevation Rmk (μm). The resultant graph is as shown in, for example, FIG. 1B.

Figure 1B:
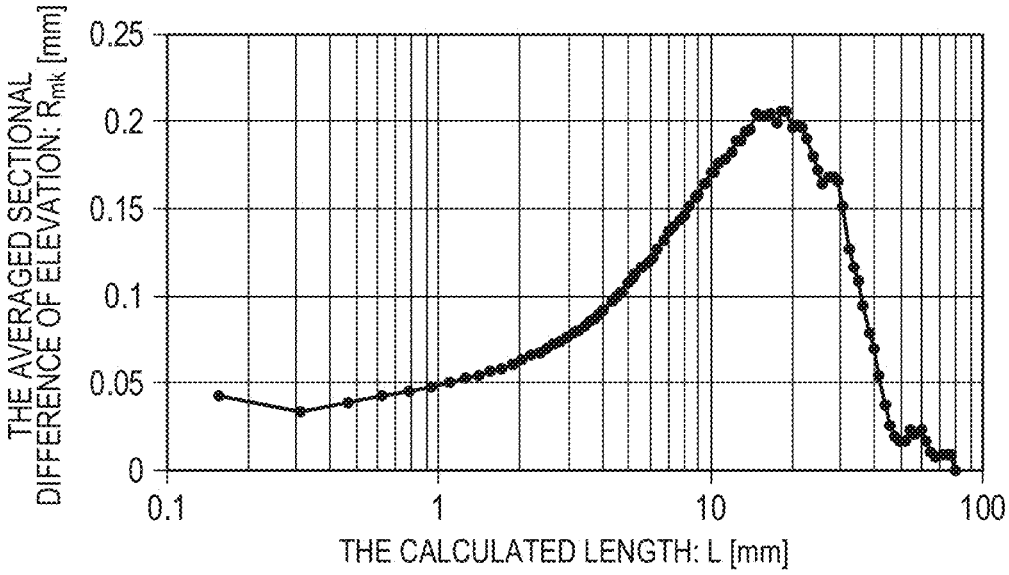
FIG. 1B is an example of a graph obtained by graphing the calculated Rmk(L) data against an axis of abscissa indicating the logarithm of an L.

In FIG. 1B, the maximum of the Rmk refers to a value of Rmk=0.206 [μm] at L=Lm=18.3 [μm]. The maximum is represented as "Rmk,max=0.206 [μm]."

In addition, in FIG. 1B, the calculated length (L) range of from 0.5 times or more to 1.5 times or less of the calculated length (Lm) at which the maximum of the averaged sectional difference of elevation (Rmk,max) is expressed refers to the range of from L=Lm·0.5=9.15 [μm] to L=Lm·1.5=27.45 [μm].

In a word, the graph of the Rmk calculated by the procedures is a graph obtained by dividing surface roughnesses of different scales and plotting these amounts against the scale of each roughness. As the values of the curve of the Rmk(L) become larger and broader, the surface of the support or layer of interest is said to be the so-called surface "having random roughnesses" in which many roughnesses of different scales are mixed.

A method of measuring the three-dimensional surface profile data in the present invention is described. No particular restriction is imposed on the measurement of the three-dimensional surface profile data. For example, a commercial atomic force microscope, electron microscope, laser microscope, optical microscope, or three-dimensional surface profile-measuring machine of a light interference system can be utilized.

The three-dimensional surface profile data can be obtained by measuring vertical direction elevation data z(x,y) corresponding to horizontal direction coordinates (x,y) with the measuring machine. In addition, the procedures for the derivation of the Rmk(L) from the resultant three-dimensional surface profile data are as described in the foregoing.

The inventors of the present invention have assumed the reason why adhesiveness between the intermediate layer and the charge generating layer is improved to be as described below.

In the compound (electron transporting material) represented by the formula (1), 2 or more hydrophilic substituents, such as a hydroxy group and a carboxyl group, are present as polymerizable functional groups at $R^1$, but $R^2$ is free of any such hydrophilic substituent and hence has a structure having high hydrophobicity. The electron transporting material is dispersed in the intermediate layer but a large amount thereof is oriented toward the vicinity of the surface on a charge generating layer side in a process for the formation of the intermediate layer because of the structure. Accordingly, the material may interact with the phthalocyanine pigment having high planarity and a π-electron interaction at a contact interface between the intermediate layer and the charge generating layer. A cured film involves reductions in mass and volume in a process for its curing reaction. As described above, the compound represented by the formula (1) is oriented toward the vicinity of the surface. Accordingly, the surface is liable to be flat after the curing reaction, and the flat surface is disadvantageous to the adhesiveness. However, the interaction at the contact interface between the intermediate layer and the charge generating layer acts on the compound represented by the formula (1). Accordingly, when the surface of the intermediate layer on a charge generating layer side has such a surface profile that in the calculated length range of from 0.5 times or more to 1.5 times or less of the calculated length at which the maximum of the averaged sectional difference of elevation (Rmk,max) is expressed in the calculated length range of from 0.1 μm or more to 100 μm or less, the value for the averaged sectional difference of elevation (Rmk) is 0.05 μm or more, the interaction strongly acts and impact from the outside can be randomly dispersed. In view of the foregoing, the inventors have considered that the adhesiveness between the layers is markedly improved by a synergistic effect.

Next, the construction of the electrophotographic photosensitive member according to the present invention is described.

The electrophotographic photosensitive member of the present invention can adopt the following two kinds of constructions:

1: a construction including a support, an intermediate layer formed directly on the support, a charge generating layer formed directly on the intermediate layer, and a charge transporting layer in the stated order; and
2: a construction including a support, an undercoat layer formed directly on the support, an intermediate layer formed directly on the undercoat layer, a charge generating layer formed directly on the intermediate layer, and a charge transporting layer in the stated order.

A cylindrical electrophotographic photosensitive member is widely used as a general electrophotographic photosensitive member, but an electrophotographic photosensitive member of any other shape, such as a belt shape or a sheet shape, can also be used.

Each item is described below.

[Support]

The support is preferably a support having electroconductivity (electroconductive support). For example, a support made of a metal, such as aluminum, nickel, copper, gold, or iron, or an alloy thereof can be used. Examples thereof include: a support obtained by forming, on an insulating support, such as a polyester, a polycarbonate, a polyimide, or a glass, a thin film of a metal, such as aluminum, silver, or gold; and a support obtained by forming a thin film of an electroconductive material, such as indium oxide or tin oxide, thereon.

The surface profile of the support is not limited, and an approach to providing the support with the surface profile is, for example, a honing treatment, an electrochemical treatment, such as anodization, a blast treatment, or a cutting treatment. However, the approach to providing the support with the surface profile is not limited thereto.

[Undercoat Layer]

One or more undercoat layers, such as an electroconductive layer, may be arranged between the support and the intermediate layer to be described later. The undercoat layer is obtained by, for example, forming a coating film of a coating liquid for an electroconductive layer, which is obtained by dispersing electroconductive particles in a resin, on the support, and drying the coating film. Examples of the electroconductive particles include: carbon black; acetylene black; metal powders, such as aluminum, nickel, iron, nichrome, copper, zinc, and silver; and metal oxide powders, such as electroconductive tin oxide and ITO.

In addition, examples of the resin include a polyester, a polycarbonate, a polyvinyl butyral, an acrylic resin, a silicone resin, an epoxy resin, a melamine resin, a urethane resin, a phenol resin, and an alkyd resin. A ratio between the electroconductive particles and the resin is preferably from 1:1 to 3:1.

Examples of the solvent of the coating liquid for an undercoat layer include an ether-based solvent, an alcohol-based solvent, a ketone-based solvent, and an aromatic hydrocarbon solvent. The thickness of the undercoat layer is preferably 0.2 μm or more and 40 μm or less, more preferably 1 μm or more and 35 μm or less, still more preferably from 5 μm or more and 30 μm or less.

[Intermediate Layer]

The intermediate layer is arranged in the electrophotographic photosensitive member of the present invention.

The surface of the intermediate layer on a charge generating layer side has such a surface profile as described below. That is, the surface profile of the intermediate layer is as follows: in the calculated length (L) range of from 0.5 times or more to 1.5 times or less of the calculated length (Lm) at which the maximum of the averaged sectional difference of elevation (Rmk,max) is expressed in the calculated length (L) range of from 0.1 μm or more to 100 μm or less, the value for the averaged sectional difference of elevation (Rmk) is 0.05 μm or more. As a result, an effect is exhibited on the adhesiveness of the layer with the charge generating layer formed directly on the layer to be described later. Further, when the value for the Rmk is 0.07 μm or more, a higher effect is exhibited on the adhesiveness with the charge generating layer formed directly on the intermediate layer. The thickness of the intermediate layer is preferably 0.2 μm or more and 3.0 μm or less, more preferably 0.4 μm or more and 1.5 μm or less.

[Electron Transporting Material]

The intermediate layer in the present invention is formed of an organic cured film containing the polymer of the composition containing the compound (electron transporting material) represented by the formula (1). The intermediate layer can be formed by: applying a coating liquid for an intermediate layer onto the support or the undercoat layer; and drying and curing the liquid. The intermediate layer can be cured with, for example, heat, light, or a radiation (such as an electron beam). The composition preferably further contains a crosslinking agent, or the crosslinking agent and a resin.

The compound represented by the formula (1) is a naphthylimide compound, a peryleneimide compound, or a pyromellitic acid imide compound. Specific examples of the structure represented by X are shown in Table 1, but the present invention is not limited thereto.

TABLE 1

| X | |
|---|---|
| X1-1 | 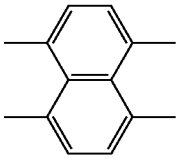 |
| X1-2 | 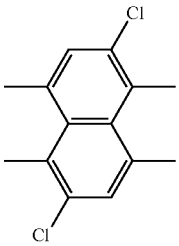  |
| X1-3 | 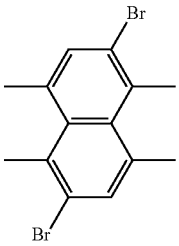  |
| X1-4 | 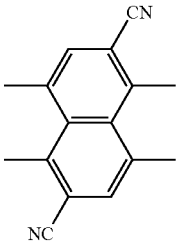  |
| X1-5 | 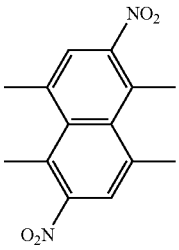  |
| X1-6 | 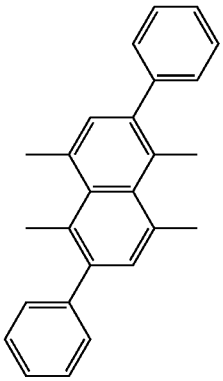 |

TABLE 1-continued
| X | |
|---|---|
| X2-1 | 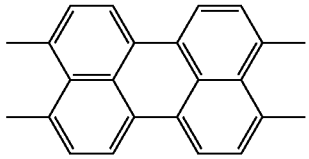 |
| X2-2 | 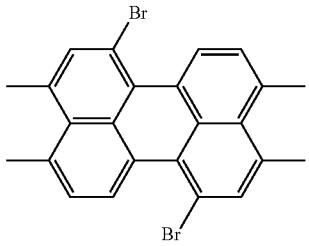  |
| X2-3 | 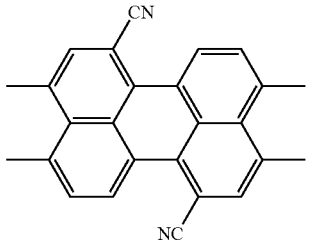  |
| X2-4 | 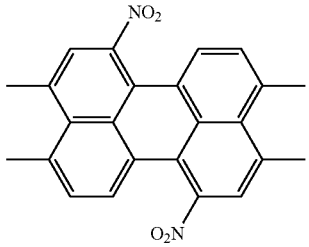  |
| X2-5 | 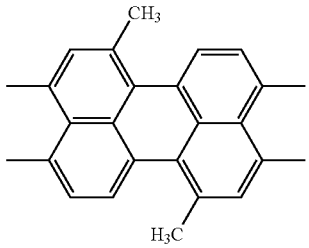  |
| X2-6 | 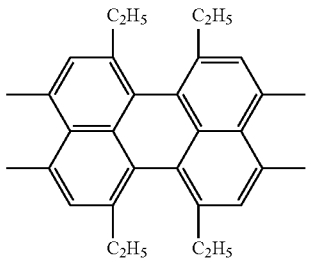  |
TABLE 1-continued
| X | |
|---|---|
| X3-1 | 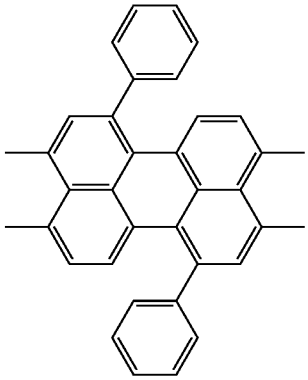 |
| X3-2 | 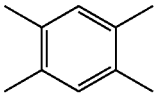 |
| X3-3 | 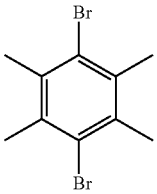  |
| X3-4 | 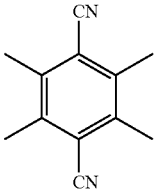  |
| X3-5 | 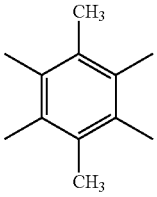  |
| X3-6 | 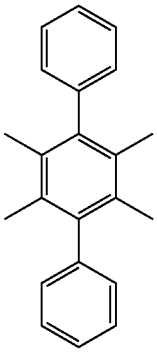 |
Further, in the compound represented by the formula (1), $R^2$ more preferably represents a group represented by the formula (2). The presence of the group may strike a satisfactory balance between the orientation of the electron transporting material toward the surface of the intermediate layer and its dispersion in the intermediate layer to exhibit a more excellent suppressing effect on the positive ghost.

(2)

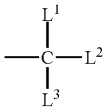

In the formula (2), $L^1$ represents a hydrogen atom, and $L^2$ and $L^3$ each independently represent a substituted or unsubstituted alkyl group having 1 to 5 carbon atoms in a main chain thereof, a group derived by substituting at least one $CH_2$ in a main chain of a substituted or unsubstituted alkyl group having 2 to 5 carbon atoms in the main chain with an oxygen atom, a group derived by substituting at least one $CH_2$ in a main chain of a substituted or unsubstituted alkyl group having 2 to 5 carbon atoms in the main chain with $NR^{19}$, a group derived by substituting at least one $C_2H_4$ in a main chain of a substituted or unsubstituted alkyl group having 3 to 5 carbon atoms in the main chain with COO, or a substituted or unsubstituted aryl group. A substituent of the alkyl group is an alkyl group having 1 to 4 carbon atoms, a benzyl group, an alkoxycarbonyl group, or a phenyl group, and a substituent of the aryl group is a halogen atom, a cyano group, a nitro group, a methyl group, an ethyl group, an isopropyl group, a n-propyl group, a n-butyl group, an acyl group, an alkoxy group, an alkoxycarbonyl group, or an aminoalkoxy group. $R^{19}$ represents a hydrogen atom or an alkyl group having 1 to 3 carbon atoms in a main chain thereof.

The alkyl group having 1 to 5 carbon atoms in the main chain serving as any one of $L^2$ and $L^3$ in the group represented by the formula (2) is a linear alkyl group or a branched alkyl group. Examples thereof include, but not limited to, a methyl group, an ethyl group, a propyl group, an isopropyl group, a n-butyl group, a s-butyl group, a t-butyl group, an isobutyl group, a n-pentyl group, a pentan-2-yl group, a pentan-3-yl group, a 2-methylbutyl group, a 2-methylbutan-2-yl group, a 3-methylbutan-2-yl group, a 3-methylbutyl group, and a 2,2-dimethylpropyl group. In addition, in the compound represented by the formula (2), Examples of the alkyl group having 1 to 3 carbon atoms in a main chain thereof serving as $R^{19}$ include a methyl group, an ethyl group, a propyl group, an isopropyl group.

Examples of the group derived by substituting at least one $CH_2$ in a main chain of an alkyl group having 2 to carbon atoms in the main chain with an oxygen atom serving as any one of $L^2$ and $L^3$ in the group represented by the formula (2) include a methoxy group, an ethoxy group, a methoxymethyl group, a n-propoxy group, an isopropoxy group, an ethoxymethyl group, a 2-methoxyethyl group, a methoxymethoxy group, a 1-methoxyethyl group, a n-butoxy group, a n-propoxymethyl group, a 2-ethoxyethyl group, a 3-methoxypropyl group, an ethoxymethoxy group, a methoxymethoxymethyl group, a methoxyethoxy group, a 1-ethoxyethyl group, a 1-methoxypropan-2-yl group, a 1-methoxypropyl group, a 1,1-dimethoxymethyl group, a sec-butoxy group, a 2-methoxypropyl group, a 1-methoxyethoxy group, a 2-methoxypropan-2-yl group, an isobutoxy group, a tert-butoxy group, and a 1-isopropoxyethyl group.

Examples of the group derived by substituting at least one $CH_2$ in a main chain of an alkyl group having 2 to 5 carbon atoms in the main chain with $NR^{19}$ serving as any one of $L^2$ and $L^3$ in the group represented by the formula (2) include a methyl$R^{19}$amino group, an ethyl$R^{19}$amino group, a (methyl$R^{19}$amino)methyl group, a n-propyl$R^{19}$amino group, an isopropyl$R^{19}$amino group, an (ethyl$R^{19}$amino)methyl group, a 2-(methyl$R^{19}$amino)ethyl group, a (methyl$R^{19}$amino)methyl$R^{19}$amino group, a 1-(methyl$R^{19}$amino)ethyl group, a n-butyl$R^{19}$amino group, a (n-propyl$R^{19}$amino)methyl group, a 2-(ethyl$R^{19}$amino)ethyl group, a 3-(methyl$R^{19}$amino)propyl group, an (ethyl$R^{19}$amino)methyl$R^{19}$amino group, a (methyl$R^{19}$amino)methyl$R^{19}$aminomethyl group, a (methyl$R^{19}$amino)ethyl$R^{19}$amino group, a 1-(ethyl$R^{19}$amino)ethyl group, a 1-(methyl$R^{19}$amino)propan-2-yl group, a 1-(methyl$R^{19}$amino)propyl group, a 1,1-(methyl$R^{19}$amino)methyl group, a sec-butyl$R^{19}$amino group, a 2-(methyl$R^{19}$amino)propyl group, a 1-(methyl$R^{19}$amino)ethyl$R^{19}$amino group, a 2-(methyl$R^{19}$amino)propan-2-yl group, an isobutyl$R^{19}$amino group, a tert-butyl$R^{19}$amino group, and a (1-isopropyl$R^{19}$amino)ethyl group.

Examples of the group derived by substituting at least one $C_2H_4$ in a main chain of a substituted or unsubstituted alkyl group having 3 to 5 carbon atoms in the main chain with COO serving as any one of $L^2$ and $L^3$ in the group represented by the formula (2) include: alkylcarbonyloxy groups, such as an acetyloxymethyl group, an ethylcarbonyloxymethyl group, a 2-acetyloxyethyl group, and a 1-acetyloxyethyl group; and alkoxycarbonyl groups, such as a methoxycarbonyl group, an ethoxycarbonyl group, a methoxycarbonylmethyl group, a n-propoxycarbonyl group, an isopropoxycarbonyl group, an ethoxycarbonylmethyl group, a 2-methoxycarbonylethyl group, and a 1-methoxycarbonylethyl group.

Examples of a substituent of each of the alkyl group having 1 to 5 carbon atoms in a main chain thereof, the alkyl group having 1 to 3 carbon atoms in a main chain thereof, the group derived by substituting at least one $CH_2$ in the main chain of the alkyl group having 2 to 5 carbon atoms with an oxygen atom, the group derived by substituting at least one $CH_2$ in the main chain of the alkyl group having 2 to 5 carbon atoms with $NR^{19}$, and the group derived by substituting at least one $C_2H_4$ in the main chain of the alkyl group having 3 to 5 carbon atoms with COO include, but not limited to, an alkyl group having 1 to 4 carbon atoms, an alkoxycarbonyl group, a benzyl group, and a phenyl group. Examples of the alkyl group having 1 to 4 carbon atoms serving as the substituent include a methyl group, an ethyl group, a n-propyl group, an isopropyl group, a n-butyl group, a sec-butyl group, a tert-butyl group, and an isobutyl group. In addition, the alkoxycarbonyl group serving as the substituent is a group having bonded thereto the alkyl group having 1 to 4 carbon atoms serving as the substituent through an oxycarbonyl (OCO) group. Further, the substituent of the alkyl group having 1 to 5 carbon atoms in a main chain thereof, the alkyl group having 1 to 3 carbon atoms in a main chain thereof, the group derived by substituting at least one $CH_2$ in the main chain of the alkyl group having 2 to 5 carbon atoms with an oxygen atom, the group derived by substituting at least one $CH_2$ in the main chain of the alkyl group having 2 to 5 carbon atoms with $NR^{19}$, or the group derived by substituting at least one $C_2H_4$ in the main chain of the alkyl group having 3 to 5 carbon atoms with COO may be substituted with one of those substituents alone, or may be simultaneously substituted with two or more of the substituents. Alternatively, the substituents may each be further substituted with any other of the substituents.

Examples of the aryl group serving as any one of $L^2$ and $L^3$ in the group represented by the formula (2) include, but not limited to, a phenyl group, a naphthyl group, a fluorenyl group, an anthranyl group, and a phenanthrenyl group.

Examples of the substituent of the aryl group in the group represented by the formula (2) include, but not limited to, a halogen atom, a cyano group, a nitro group, a methyl group, an ethyl group, an isopropyl group, a n-propyl group, a n-butyl group, an acyl group, an alkoxy group, an alkoxycarbonyl group, and an aminoalkoxy group. Examples of the halogen atom serving as the substituent can include fluorine, chlorine, bromine, and iodine. In addition, the acyl group serving as the substituent is a group having bonded thereto a methyl group, an ethyl group, an isopropyl group, a n-propyl group, or a n-butyl group through a carbonyl group. Further, the alkoxy group serving as the substituent is a group having bonded thereto a methyl group, an ethyl group, an isopropyl group, a n-propyl group, or a n-butyl group through an oxygen atom. Further, the alkoxycarbonyl group serving as the substituent is a group having bonded thereto a methyl group, an ethyl group, an isopropyl group, a n-propyl group, or a n-butyl group through an oxycarbonyl (OCO) group. Further, the aminoalkoxy group serving as the substituent is a group obtained by substituting the alkoxy group with one or two or more amino groups. The aryl group may be substituted with one of those substituents alone, or may be simultaneously substituted with two or more of the substituents, and the methyl group, the ethyl group, the isopropyl group, the n-propyl group, the n-butyl group, the acyl group, the alkoxy group, the alkoxycarbonyl group, or the aminoalkoxy group may be further substituted with any other halogen atom, cyano group, nitro group, methyl group, ethyl group, isopropyl group, n-propyl group, n-butyl group, acyl group, alkoxy group, or alkoxycarbonyl group.

[Crosslinking Agent]

A compound that polymerizes (cures) or crosslinks with the compound (electron transporting material) represented by the formula (1) can be used as the crosslinking agent. Specifically, for example, a compound described in "Crosslinking Agent Handbook" edited by Shinzo Yamashita and Tosuke Kaneko, and published by Taiseisha Ltd. (1981) can be used.

Examples of the crosslinking agent include an isocyanate compound and an amine compound described below, but the present invention is not limited thereto. In addition, a plurality of crosslinking agents may be used in combination.

The isocyanate compound is preferably an isocyanate compound having a plurality of isocyanate groups or blocked isocyanate groups. Examples of the isocyanate compound include triisocyanatobenzene, triisocyanatomethylbenzene, triphenylmethane triisocyanate, lysine triisocyanate, and an isocyanurate modified product, biuret modified product, allophanate modified product, and trimethylolpropane or pentaerythritol adduct modified product of a diisocyanate, such as tolylene diisocyanate, hexamethylene diisocyanate, dicyclohexylmethane diisocyanate, naphthalene diisocyanate, diphenylmethane diisocyanate, isophorone diisocyanate, xylylene diisocyanate, 2,2,4-trimethylhexamethylene diisocyanate, methyl 2,6-diisocyanatohexanoate, or norbornane diisocyanate. Of those, an isocyanurate modified product and an adduct modified product are more preferred.

A compound that can be purchased as the isocyanate compound (crosslinking agent) is exemplified by: an isocyanate-based crosslinking agent, such as DURANATE MFK-60B or SBA-70B manufactured by Asahi Kasei Chemicals Corporation or DESMODUR BL3175 or BL3475 manufactured by Sumika Bayer Urethane Co., Ltd.; an amino-based crosslinking agent, such as U-VAN 20SE60 or 220 manufactured by Mitsui Chemicals, Inc. or SUPER BECKAMINE L-125-60 or G-821-60 manufactured by DIC Corporation; or an acrylic crosslinking agent, such as FANCRYL FA-129AS or FA-731A manufactured by Hitachi Chemical Co., Ltd.

The amine compound is preferably, for example, an amine compound having a plurality of N-methylol groups or alkyl-etherified N-methylol groups. Examples thereof include methylolated melamine, methylolated guanamine, a methylolated urea derivative, a methylolated ethylene urea derivative, methylolated glycoluril, and these compounds whose methylol sites are alkyl-etherified, and derivatives thereof.

A compound that can be purchased as the amine compound (crosslinking agent) is exemplified by SUPER MELAMI No. 90 (manufactured by NIppon Oil & Fats Co., Ltd.), SUPER BECKAMINE (trademark) TD-139-60, L-105-60, L127-60, L110-60, J-820-60, or G-821-60 (manufactured by DIC Corporation), U-VAN 2020 (manufactured by Mitsui Chemicals, Inc.), Sumitex Resin M-3 (manufactured by Sumitomo Chemical Company), NIKALAC MW-30, MW-390, or MX-750LM (manufactured by Nippon Carbide Industries Co., Inc.), SUPER BECKAMINE (trademark) L-148-55, 13-535, L-145-60, or TD-126 (manufactured by DIC Corporation), NIKALAC BL-60 or BX-4000 (manufactured by Nippon Carbide Industries Co., Inc.), or NIKALAC MX-280, NIKALAC MX-270, or NIKALAC MX-290 (manufactured by Nippon Carbide Industries Co., Inc.).

[Resin]

A resin having a polymerizable functional group capable of polymerizing (curing) with the compound represented by the formula (1) can be used as the resin. Preferred examples of the polymerizable functional group include a hydroxy group, a thiol group, an amino group, a carboxyl group, and a methoxy group.

Examples of the resin having a polymerizable functional group include polyether polyol, polyester polyol, polyacrylic polyol, polyvinyl alcohol, polyvinyl acetal, polyamide, a carboxyl group-containing resin, polyamine, and polythiol. The present invention is not limited thereto. In addition, a plurality of the resins may be used in combination.

A resin that can be purchased as the resin having a polymerizable functional group is exemplified by: a polyether polyol-based resin, such as AQD-457 or AQD-473 manufactured by Nippon Polyurethane Industry Co., Ltd. or SANNIX GP-400 or GP-700 manufactured by Sanyo Chemical Industries, Ltd.; a polyester polyol-based resin, such as PHTHALKYD W2343 manufactured by Hitachi Chemical Co., Ltd., WATERSOL S-118 or CD-520 manufactured by DIC Corporation, or HARIDIP WH-1188 manufactured by Harima Chemicals; a polyacrylic polyol-based resin, such as BURNOCK WE-300 or WE-304 manufactured by DIC Corporation; a polyvinyl alcohol-based resin, such as KURARAY POVAL PVA-203 manufactured by Kuraray Co., Ltd; a polyvinyl acetal-based resin, such as BX-1, BM-1, KS-1, or KS-5 manufactured by Sekisui Chemical Co., Ltd.; a polyamide-based resin, such as TORESIN FS-350 manufactured by Nagase ChemteX Corporation; a carboxyl group-containing resin, such as AQUALIC manufactured by Nippon Shokubai Co., Ltd. or FINELEX SG2000 manufactured by Namariichi Co., Ltd.; a polyamine, such as LUCKAMIDE manufactured by DIC Corporation; or a polythiol, such as QE-340M manufactured by Toray Industries, Inc.

The weight-average molecular weight of the resin having a polymerizable functional group falls within the range of preferably from 5,000 to 400,000, more preferably from 5,000 to 300,000.

A ratio between the compound represented by the formula (1) and any other composition in the composition is preferably from 100:50 to 100:250 from the viewpoint of the suppression of the positive ghost.

The intermediate layer may contain, for example, any other resin (resin free of any polymerizable functional group), organic particles, inorganic particles, or a leveling agent in addition to the polymer for improving its film formability and electrical characteristics. However, the content of such material in the intermediate layer is preferably 50 mass % or less, more preferably 20 mass % or less with respect to the total mass of the intermediate layer.

The intermediate layer in the present invention can further contain particles. The incorporation of the particles can effectively increase the value for the averaged sectional difference of elevation Rmk.

The number-average particle diameter of the particles is preferably 0.2 μm or less, and the number-average particle diameter of the particles is more preferably 0.005 μm or more and 0.1 μm or less because the value for the Rmk can be effectively increased.

[Particles]

Examples of the particles include inorganic particles and organic resin particles. In particular, inorganic particles are preferred from the viewpoint that the effect of the present invention can be more effectively obtained.

Examples of the inorganic particles include metal oxides, inorganic salts, such as inorganic chlorides and inorganic bromides, inorganic oxides, clay, and ceramics, such as silicon nitride. Of those, an inorganic oxide is preferred from the viewpoint of the chemical stability of a compound. In particular, silica, alumina, titanium oxide, or zinc oxide is preferred. In addition, one kind of those particles may be used alone, or two or more kinds thereof may be used in combination.

In addition, particles obtained by subjecting surfaces of the inorganic particles to a hydrophobizing treatment may be used. As a surface treatment agent, there is given, for example, a silane coupling agent. Specific examples of the silane coupling agent include γ-(2-aminoethyl)aminopropyltrimethoxysilane, γ-(2-aminoethyl)aminopropylmethyldimethoxysilane, γ-methacryloxypropyltrimethoxysilane, N-β-(N-vinylbenzylaminoethyl)-γ-aminopropyltrimethoxysilane hydrochloride, hexamethyldisilazane, methyltrimethoxysilane, butyltrimethoxysilane, isobutyltrimethoxysilane, hexyltrimethoxysilane, octyltrimethoxysilane, decyltrimethoxysilane, dodecyltrimethoxysilane, phenyltrimethoxysilane, o-methylphenyltrimethoxysilane, and p-methylphenyltrimethoxysilane.

Examples of the organic resin particles include resin particles, such as particles of curable rubber, polyurethane, polymethyl methacrylate, an epoxy resin, an alkyd resin, a phenol resin, polyester, a silicone resin, an acrylic-melamine resin, or a fluorine atom-containing resin.

The particles to be mixed in the intermediate layer may be powdery, or may be mixed in the state of a slurry dispersed in a solvent. The powdery particles can be dispersed with any one of: various emulsifying machines and dispersing machines, such as a homogenizer, a line mixer, an ultradisperser, a homomixer, a liquid collision-type high-speed dispersing machine, and an ultrasonic dispersing machine; and mixing apparatus, such as a mixer.

A solvent to be used in the coating liquid for an intermediate layer is, for example, an alcohol-based solvent, a sulfoxide-based solvent, a ketone-based solvent, an ether-based solvent, an ester-based solvent, or an aromatic hydrocarbon solvent.

Specific examples of the electron transporting material are shown in Tables 2-1 to 2-3 below, but the present invention is not limited thereto. X in Tables 2-1 to 2-3 represents X shown in Table 1. In the present invention, one kind of the electron transporting materials may be used alone, or two or more kinds thereof may be used in combination.

TABLE 2-1

| Exemplified | | | $R^2$ | | |
|---|---|---|---|---|---|
| Compound | X | $R^1$ | $L^1$ | $L^2$ | $L^3$ |
| 101 | 2-1 | 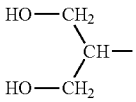 | H | n-$C_3H_7$ | n-$C_3H_7$ |
| 102 | 2-1 | 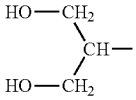 | H | $CH_3$ | n-$C_5H_{11}$ |
| 103 | 2-1 | 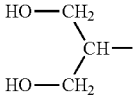 | H | $C_2H_5$ | $CH_2OCH_3$ |
| 104 | 2-1 | 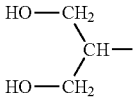 | H | 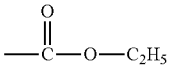 | $CH_2CH(CH_3)_2$ |

TABLE 2-1-continued
| Exemplified Compound | X | $R^1$ | $R^2$ $L^1$ | $L^2$ | $L^3$ |
|---|---|---|---|---|---|
| 105 | 2-1 | 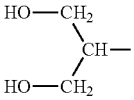 | H | 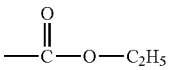 | 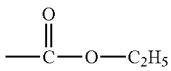 |
| 106 | 2-1 | 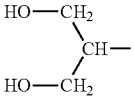 | H | 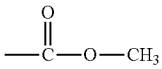 | $CH_2Ph$ |
| 107 | 2-1 | 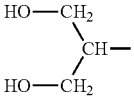 | H | $CH_3$ | 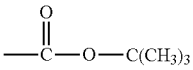 |
| 108 | 2-1 | 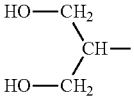 | H | $CH_3$ | Ph |
| 109 | 2-1 | 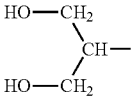 | H | Ph | Ph |
| 110 | 2-1 | 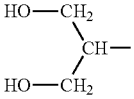 | H | $CH_3$ | $CH_2CH(CH_3)C_2H_5$ |
| 111 | 2-1 | 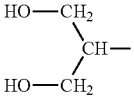 | H | $C_2H_5$ | $C_2H_5$ |
| 112 | 2-1 | 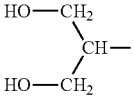 | H | $CH_3$ | $(CH_2)_3CH(CH_3)_2$ |
| 113 | 2-1 | 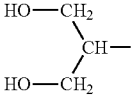 | H | H | n-$C_5H_{11}$ |
| 114 | 2-1 | 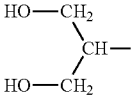 | H | H | $CH_2CH(C_2H_5)$n-$C_4H_9$ |
| 115 | 2-1 | 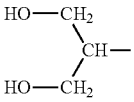 | H | H | $CH_2CH(OC_2H_5)_2$ |
| 116 | 2-1 | 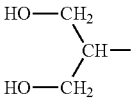 | H | H | $C_2H_4N(CH_3)_2$ |
| 117 | 2-1 | 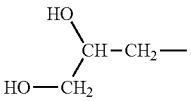 | H | n-$C_3H_7$ | n-$C_3H_7$ |

TABLE 2-1-continued
| Exemplified Compound | X | $R^1$ | $R^2$ $L^1$ | $L^2$ | $L^3$ |
|---|---|---|---|---|---|
| 118 | 2-1 | 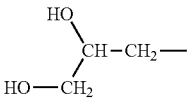 | H | 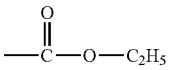 | $CH_2CH(CH_3)_2$ |
| 119 | 2-1 | 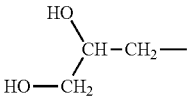 | H | Ph | Ph |
| 120 | 2-1 | 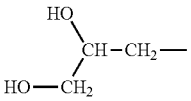 | H | H | $CH_2CH(C_2H_5)n\text{-}C_4H_9$ |
TABLE 2-2
| Exemplified Compound | X | $R^1$ | $R^2$ $L^1$ | $L^2$ | $L^3$ |
|---|---|---|---|---|---|
| 121 | 2-1 | 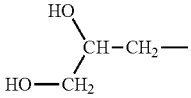 | H | H | $CH_2CH(OC_2H_5)_2$ |
| 122 | 2-1 | 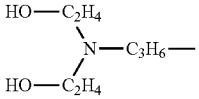 | H | $n\text{-}C_3H_7$ | $n\text{-}C_3H_7$ |
| 123 | 2-1 | 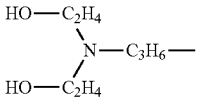 | H | 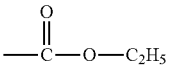 | $CH_2CH(CH_3)_2$ |
| 124 | 2-1 | 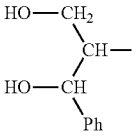 | H | $CH_3$ | $n\text{-}C_5H_{11}$ |
| 125 | 2-2 | 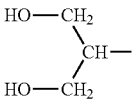 | H | $n\text{-}C_3H_7$ | $n\text{-}C_3H_7$ |
| 126 | 2-2 | 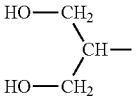 | H | $CH_3$ | $n\text{-}C_5H_{11}$ |
| 127 | 2-2 | 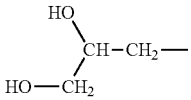 | H | $n\text{-}C_3H_7$ | $n\text{-}C_3H_7$ |
| 128 | 2-3 | 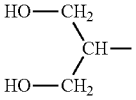 | H | $n\text{-}C_3H_7$ | $n\text{-}C_3H_7$ |

TABLE 2-2-continued
| Exemplified Compound | X | $R^1$ | $R^2$ $L^1$ | $L^2$ | $L^3$ |
|---|---|---|---|---|---|
| 129 | 2-3 | 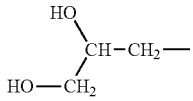 | H | n-$C_3H_7$ | n-$C_3H_7$ |
| 130 | 2-1 | 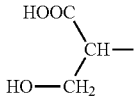 | H | $CH_3$ | n-$C_5H_{11}$ |
| 131 | 2-1 | 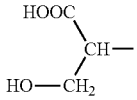 | H | $C_2H_5$ | $CH_2OCH_3$ |
| 132 | 2-1 | 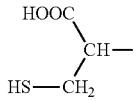 | H | n-$C_3H_7$ | n-$C_3H_7$ |
| 133 | 2-1 | 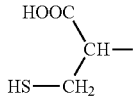 | H | Ph | Ph |
| 134 | 2-1 | 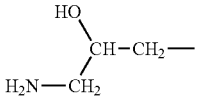 | H | $CH_3$ | n-$C_5H_{11}$ |
| 135 | 2-1 | 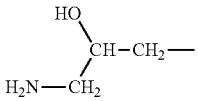 | H | $C_2H_5$ | $CH_2OCH_3$ |
| 136 | 2-1 | 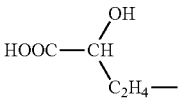 | H | $CH_3$ | n-$C_5H_{11}$ |
| 137 | 2-1 | 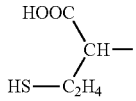 | H | n-$C_3H_7$ | n-$C_3H_7$ |
| 138 | 2-1 | 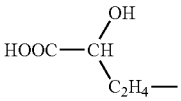 | H | $CH_3$ | n-$C_5H_{11}$ |
| 139 | 2-1 | 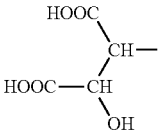 | H | n-$C_3H_7$ | n-$C_3H_7$ |
| 140 | 2-1 | 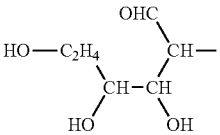 | H | $CH_3$ | n-$C_5H_{11}$ |

TABLE 2-2-continued
| Exemplified Compound | X | $R^1$ | $R^2$ $L^1$ | $L^2$ | $L^3$ |
|---|---|---|---|---|---|
| 141 | 2-1 | 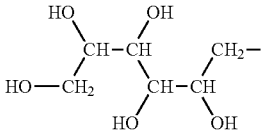 | H | n-$C_3H_7$ | n-$C_3H_7$ |
TABLE 2-3
| Exemplified Compound | X | $R^1$ | $R^2$ |
|---|---|---|---|
| 201 | 2-1 | 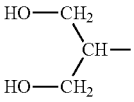 | 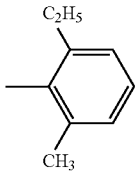 |
| 202 | 2-1 | 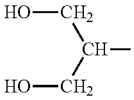 | 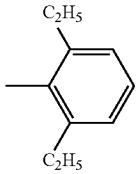 |
| 203 | 2-1 | 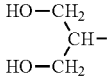 | 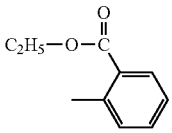 |
| 204 | 2-1 | 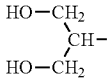 | 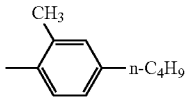 |
| 205 | 2-1 | 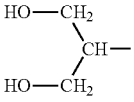 | 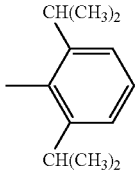 |
| 206 | 2-1 | 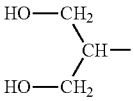 | 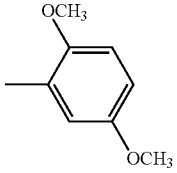 |
| 207 | 2-1 | 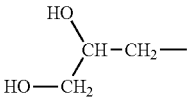 | 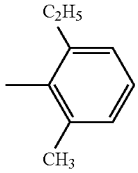 |
TABLE 2-3-continued
| Exemplified Compound | X | $R^1$ | $R^2$ |
|---|---|---|---|
| 208 | 2-1 | 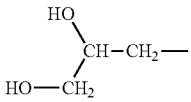 | 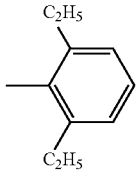 |
| 209 | 2-1 | 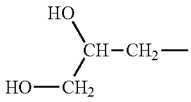 | 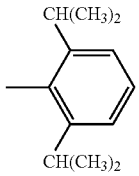 |
| 210 | 2-1 | 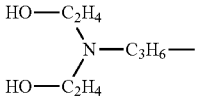 | 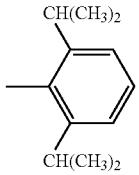 |
| 211 | 2-1 | 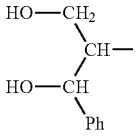 | 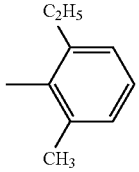 |
| 212 | 2-2 | 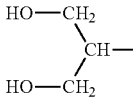 | 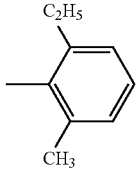 |
| 213 | 2-2 | 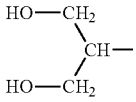 | 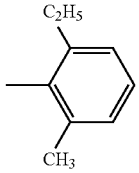 |

TABLE 2-3-continued

| Exemplified Compound | X | $R^1$ | $R^2$ |
|---|---|---|---|
| 214 | 2-2 | 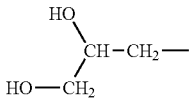 | 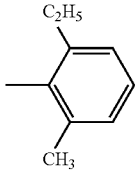 |
| 215 | 2-3 | 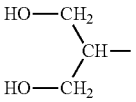 | 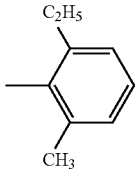 |
| 216 | 2-3 | 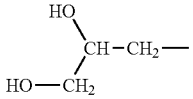 | 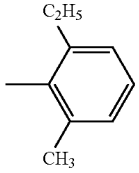 |
| 217 | 2-1 | 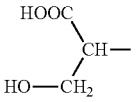 | 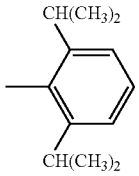 |
| 218 | 2-1 | 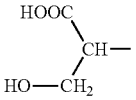 | 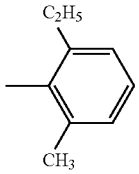 |
| 219 | 2-1 | 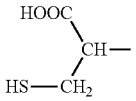 | 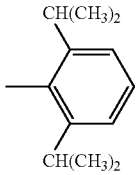 |
| 220 | 2-1 | 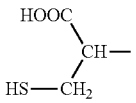 | 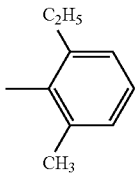 |
| 221 | 2-1 | 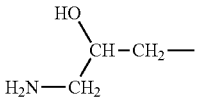 | 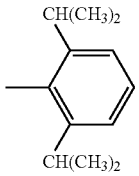 |

TABLE 2-3-continued

| Exemplified Compound | X | $R^1$ | $R^2$ |
|---|---|---|---|
| 222 | 2-1 | 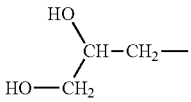 | 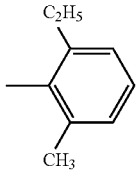 |
| 223 | 2-1 | 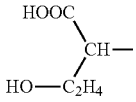 | 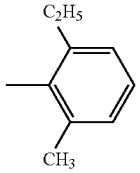 |
| 224 | 2-1 | 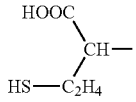 | 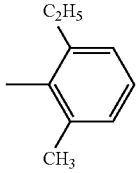 |
| 225 | 2-1 | 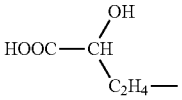 | 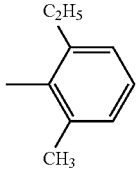 |
| 226 | 2-1 | 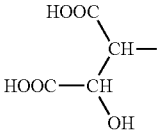 | 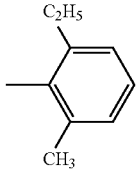 |
| 227 | 2-1 | 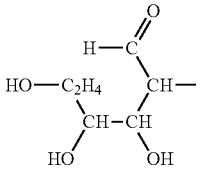 | 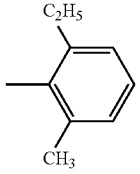 |
| 228 | 2-1 | 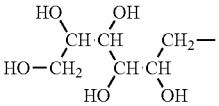 | 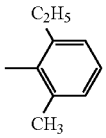 |

The compound (electron transporting material) represented by the formula (1) can be synthesized by using a known synthesis method described in, for example, U.S. Pat. Nos. 4,442,193, 4,992,349, 5,468,583, or Chemistry of Materials, Vol. 19, No. 11, 2703-2705 (2007). In addition, the compound can be synthesized by a reaction between naphthalene tetracarboxylic dianhydride available from Tokyo Chemical Industry Co., Ltd., Sigma-Aldrich Japan K.K., or Johnson Matthey Japan Incorporated and a monoamine derivative.

The compound represented by the formula (1) has a substituent that can react with the crosslinking agent (a hydroxy group, a thiol group, an amino group, or a carboxyl group). A method of introducing such substituent into the compound represented by the formula (1) is, for example, a method involving directly introducing the polymerizable functional group into the main skeleton moiety of the compound represented by the formula (1), which is obtained by the above-mentioned method, or a method involving introducing a structure having the polymerizable functional group or a functional group that can serve as a precursor of the polymerizable functional group. Examples of the latter method include: a method involving introducing a functional group-containing aryl group into a halide of a naphthylimide derivative through the use of a cross-coupling reaction involving using a palladium catalyst and a base; a method involving introducing a functional group-containing alkyl group into the halide of the naphthylimide derivative through the use of a cross-coupling reaction involving using a $FeCl_3$ catalyst and a base; a method involving subjecting the halide of the naphthylimide derivative to lithiation and then causing an epoxy compound or $CO_2$ to act on the resultant to introduce a hydroxyalkyl group or a carboxyl group; and a method involving using a naphthalene tetracarboxylic dianhydride derivative or a monoamine derivative having the polymerizable functional group or a functional group that can serve as a precursor of the polymerizable functional group as a raw material at the time of the synthesis of the naphthylimide derivative.

[Charge Generating Layer]

The charge generating layer is formed directly on the intermediate layer.

As a charge generating material to be used for the charge generating layer, there are given, for example, phthalocyanine pigments, such as a metal phthalocyanine and a metal-free phthalocyanine. A plurality of the phthalocyanine pigments may be used in combination. Of the phthalocyanine pigments, oxytitanium phthalocyanine, chlorogallium phthalocyanine, or hydroxygallium phthalocyanine is preferred.

Preferred examples of the oxytitanium phthalocyanine include: an oxytitanium phthalocyanine crystal of a crystal form having peaks at Bragg angles (2θ±0.2°) in CuKα characteristic X-ray diffraction of 9.0°, 14.2°, 23.9°, and 27.1°; and an oxytitanium phthalocyanine crystal of a crystal form having strong peaks at Bragg angles (2θ±0.2°) of 9.5°, 9.7°, 11.7°, 15.0°, 23.5°, 24.1°, and 27.3°.

Preferred examples of the chlorogallium phthalocyanine include: a chlorogallium phthalocyanine crystal of a crystal form having peaks at Bragg angles (2θ±0.2°) in CuKα characteristic X-ray diffraction of 7.4°, 16.6°, 25.5°, and 28.2°; a chlorogallium phthalocyanine crystal of a crystal form having peaks at Bragg angles (2θ±0.2°) of 6.8°, 17.3°, 23.6°, and 26.9°; and a chlorogallium phthalocyanine crystal of a crystal form having peaks at Bragg angles (2θ±0.2°) of 8.7°, 9.2°, 17.6°, 24.0°, 27.4°, and 28.8°.

Preferred examples of the hydroxygallium phthalocyanine include: a hydroxygallium phthalocyanine crystal of a crystal form having peaks at Bragg angles (2θ±0.2°) in CuKα characteristic X-ray diffraction of 7.3°, 24.9°, and 28.1°; and a hydroxygallium phthalocyanine crystal of a crystal form having peaks at Bragg angles (2θ±0.2°) in CuKα characteristic X-ray diffraction of 7.5°, 9.9°, 12.5°, 16.3°, 18.6°, 25.1°, and 28.3°.

Examples of the resin to be used for the charge generating layer include: a polymer and copolymer of a vinyl compound, such as styrene, vinyl acetate, vinyl chloride, an acrylic acid ester, a methacrylic acid ester, vinylidene fluoride, or trifluoroethylene; a polyvinyl alcohol resin; a polyvinyl acetal resin; a polycarbonate resin; a polyester resin; a polysulfone resin; a polyphenylene oxide resin; a polyurethane resin; a cellulose resin; a phenol resin; a melamine resin; a silicon resin; and an epoxy resin. The incorporation of a resin having a structure represented by the formula (3) out of those resins can more effectively improve the adhesiveness with the intermediate layer.

(3)

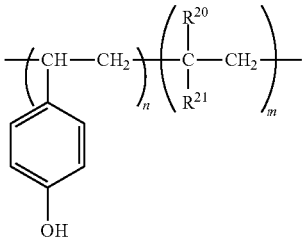

In the formula (3), n represents an integer of 1 or more, and m represents an integer of 0 or 1 or more, $R^{20}$ represents a hydrogen atom or a methyl group, and $R^{21}$ represents a methoxycarbonyl group, an ethoxycarbonyl group, a n-propoxycarbonyl group, a n-butoxycarbonyl group, a 2-hydroxyethoxycarbonyl group, a hydroxy group, or a phenyl group.

Although the mechanism via which the incorporation of the resin having a structure represented by the formula (3) improves the adhesiveness between the charge generating layer and the intermediate layer has not been elucidated, the improvement is probably because of the fact that a p-vinylphenol structure interacts with both the phthalocyanine pigment in the charge generating layer and the compound represented by the formula (1) in the intermediate layer.

In the charge generating layer, a plurality of resins may be used in combination. In addition, the mass ratio (charge generating material/binder resin) of the charge generating material to the resin preferably falls within the range of from 10/1 to 1/10, and more preferably falls within the range of from 5/1 to 1/5. A solvent to be used in a coating liquid for a charge generating layer is, for example, an alcohol-based solvent, a sulfoxide-based solvent, a ketone-based solvent, an ether-based solvent, an ester-based solvent, or an aromatic hydrocarbon solvent.

The thickness of the charge generating layer is preferably 0.05 μm or more and 5 μm or less.

Specific examples of the resin having a structure represented by the formula (3) are shown below, but the present invention is not limited thereto.

TABLE 3

| Resin | |
|---|---|
| 3-1 | 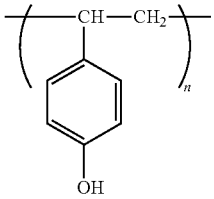 |

TABLE 3-continued

| Resin | |
|---|---|
| 3-2 | 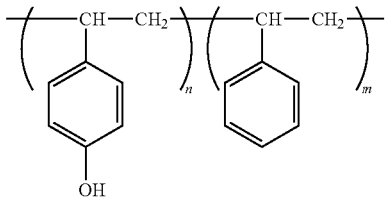 |
| 3-3 | 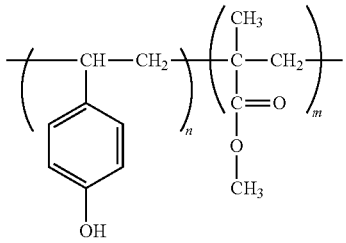 |
| 3-4 | 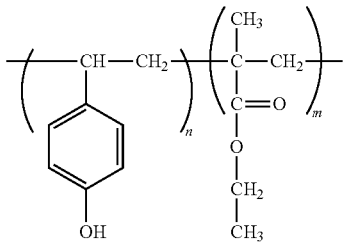 |
| 3-5 | 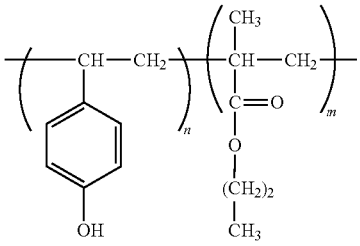 |
| 3-6 | 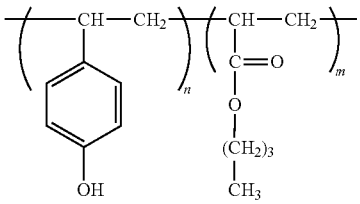 |
| 3-7 | 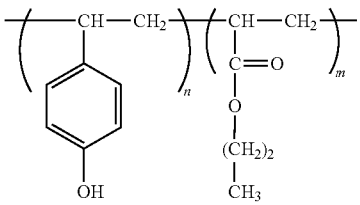 |

TABLE 3-continued

| Resin | |
|---|---|
| 3-8 | 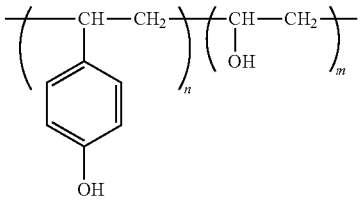 |

[Charge Transporting Layer]

The charge transporting layer is arranged on the charge generating layer.

As a charge transporting material to be used for the charge transporting layer, there is given, for example, a polymer having in its main chain or side chain a polycyclic aromatic compound, a heterocyclic compound, a hydrazone compound, a styryl compound, a benzidine compound, a triarylamine compound, or triphenylamine, or a group derived from any such compound. Of those, a triarylamine compound, a benzidine compound, or a styryl compound is preferred.

As a binder resin to be used for the charge transporting layer, there are given, for example, a polyester resin, a polycarbonate resin, a polymethacrylate resin, a polyarylate resin, a polysulfone resin, and a polystyrene resin. Of those, a polycarbonate resin or a polyarylate resin is preferred. In addition, the molecular weight of any such resin preferably falls within the range of from 5,000 to 300,000 in terms of weight-average molecular weight Mw.

In the charge transporting layer, the mass ratio (charge transporting material/binder resin) of the charge transporting material to the binder resin is preferably from 10/5 to 5/10, more preferably from 10/8 to 6/10.

The thickness of the charge transporting layer is preferably 3 μm or more and 40 μm or less, more preferably 5 μm or more and 16 μm or less. A solvent to be used in a coating liquid for a charge transporting layer is, for example, an alcohol-based solvent, a sulfoxide-based solvent, a ketone-based solvent, an ether-based solvent, an ester-based solvent, or an aromatic hydrocarbon solvent.

In addition, a protective layer may be formed on the charge transporting layer. The protective layer contains electroconductive particles or a charge transporting material and a binder resin. In addition, the protective layer may further contain an additive, such as a lubricant. In addition, electroconductivity or a charge transporting property may be imparted to the binder resin itself of the protective layer, and in that case, the electroconductive particles and the charge transporting material except the resin may not be incorporated into the protective layer. In addition, the binder resin of the protective layer may be a thermoplastic resin, or may be a curable resin that can be polymerized with heat, light, a radiation (such as an electron beam), or the like.

A method of forming each layer constituting a laminated electrophotographic photosensitive member is preferably a method involving: first applying a coating liquid obtained by dissolving and/or dispersing a material constituting each layer in a solvent to form a coating film; and then drying and/or curing the resultant coating film to form the layer. A method of applying the coating liquid is, for example, an immersion application method (immersion coating method), a spray coating method, a curtain coating method, or a spin coating method. Of those, an immersion application method is preferred from the viewpoints of efficiency and productivity.

[Process Cartridge and Electrophotographic Apparatus]

Figure 2:
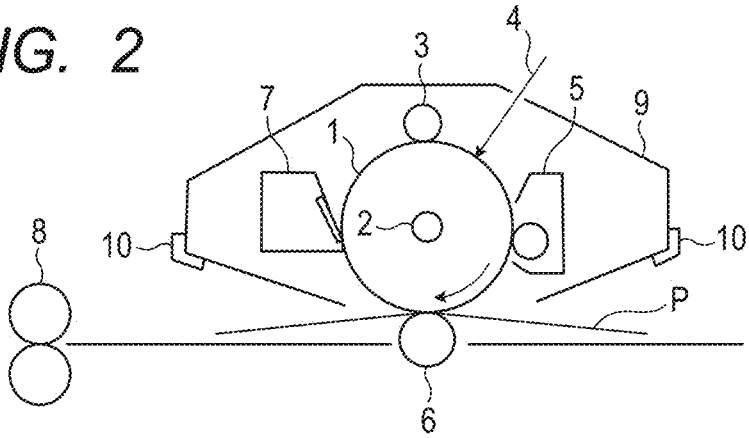
FIG. 2 is a view for illustrating an example of the schematic construction of an electrophotographic apparatus including a process cartridge of the present invention.

FIG. 2 is a view for illustrating the schematic construction of an electrophotographic apparatus including a process cartridge including an electrophotographic photosensitive member.

In FIG. 2, an electrophotographic photosensitive member 1 having a cylindrical shape is rotationally driven about an axis 2 in a direction indicated by an arrow at a predetermined peripheral speed. The surface (peripheral surface) of the electrophotographic photosensitive member 1 to be rotationally driven is uniformly charged to a predetermined positive or negative potential by a charging unit 3 (primary charging unit, such as a charging roller). Next, the surface receives exposure light (image exposure light) 4 from an exposing unit (not shown), such as slit exposure or laser beam scanning exposure. Thus, electrostatic latent images corresponding to the target image are sequentially formed on the surface of the electrophotographic photosensitive member 1.

The electrostatic latent images formed on the surface of the electrophotographic photosensitive member 1 are then developed with toner in the developer of a developing unit 5 to become toner images. Next, the toner images formed on and carried by the surface of the electrophotographic photosensitive member 1 are sequentially transferred onto a transfer material P (such as paper) by a transfer bias from a transferring unit 6 (such as a transfer roller). The transfer material P is taken out and supplied from a transfer material-supplying unit (not shown) to a space (abutment portion) between the electrophotographic photosensitive member 1 and the transferring unit 6 in synchronization with the rotation of the electrophotographic photosensitive member 1.

The transfer material P onto which the toner images have been transferred is separated from the surface of the electrophotographic photosensitive member 1 and introduced into a fixing unit 8, where the images are fixed. Thus, the transfer material is printed out as an image-formed product (print or copy) to the outside of the apparatus.

The surface of the electrophotographic photosensitive member 1 after the transfer of the toner images is cleaned through the removal of a transfer residual developer (toner) by a cleaning unit 7 (such as a cleaning blade). Next, the surface is subjected to an antistatic treatment by pre-exposure light (not shown) from a pre-exposing unit (not shown), and the electrophotographic photosensitive member 1 is then repeatedly used in image formation. When the charging unit 3 is a contact charging unit using a charging roller or the like as illustrated in FIG. 2, pre-exposure is not necessarily needed.

Two or more of components such as the electrophotographic photosensitive member 1, the charging unit 3, the developing unit 5, the transferring unit 6, and the cleaning unit 7 are selected, stored in a container, and integrally coupled to form a process cartridge. The process cartridge may be removably mounted onto the main body of the electrophotographic apparatus, such as a copying machine or a laser beam printer. In FIG. 2, the electrophotographic photosensitive member 1, the charging unit 3, the developing unit 5, and the cleaning unit 7 are integrally supported to from a cartridge. In addition, the cartridge serves as a process cartridge 9 removably mounted onto the main body of the electrophotographic apparatus by using a guiding unit 10, such as the rail of the main body of the electrophotographic apparatus.

Now, the present invention is described in more detail by way of Examples. The term "part(s)" in Examples refers to "part(s) by mass". First, a synthesis example of the imide compound (electron transporting material) represented by the formula (1) is described.

SYNTHESIS EXAMPLE 1

Under a nitrogen atmosphere, 5.4 parts of naphthalene tetracarboxylic dianhydride, 4 parts of 4-heptylamine, and 3 parts of 2-amino-1,3-propanediol were added to 200 parts of dimethylacetamide, and the mixture was stirred at room temperature for 1 hour to prepare a solution. After having been prepared, the solution was refluxed for 8 hours and separated by silica gel column chromatography (developing solvent: ethyl acetate/toluene). After that, a fraction containing a target product was concentrated. The concentrate was recrystallized with a mixed solution of ethyl acetate and toluene to provide 2.0 parts of Exemplified Compound 101.

SYNTHESIS EXAMPLE 2

Under a nitrogen atmosphere, 5.4 parts of naphthalene tetracarboxylic dianhydride, 4 parts of 2,6-diisopropylaniline, and 3 parts of 2-amino-1,3-propanediol were added to 200 parts of dimethylacetamide, and the mixture was stirred at room temperature for 1 hour to prepare a solution. After having been prepared, the solution was refluxed for 10 hours and separated by silica gel column chromatography (developing solvent: ethyl acetate/toluene). After that, a fraction containing a target product was concentrated. The concentrate was recrystallized with a mixed solution of ethyl acetate and toluene to provide 1.5 parts of Exemplified Compound 205.

Next, the production and evaluation of an electrophotographic photosensitive member are described.

EXAMPLE 1

[Support]

An undercoat layer to be described later was formed on an aluminum cylinder having a length of 260.5 mm and a diameter of 30 mm (JIS-A3003, aluminum alloy) (support 1), and the resultant was used as a support (support 2).

[Undercoat Layer]

214 Parts of titanium oxide particles covered with oxygen-deficient tin oxide ($SnO_2$), 132 parts of a phenol resin (monomer/oligomer of a phenol resin) (trade name: PRIOPHEN J-325, manufactured by DIC Corporation, resin solid content: 60 mass %), and 98 parts of 1-methoxy-2-propanol were loaded into a sand mill using 450 parts of glass beads each having a diameter of 0.8 mm, and were subjected to a dispersion treatment under the conditions of a number of rotations of 2,000 rpm, a dispersion treatment time of 4.5 hours, and a preset temperature of cooling water of 18° C. to provide a dispersion liquid.

The glass beads were removed from the dispersion liquid with a mesh (aperture: 150 μm). Silicone resin particles (trade name: TOSPEARL 120, manufactured by Momentive Performance Materials Inc., average particle diameter: 2 μm) serving as a surface roughness imparting material were added to the dispersion liquid after the removal of the glass beads so that their addition amount became 10 mass % with respect to the total mass of the metal oxide particles and the binder material in the dispersion liquid. In addition, a silicone oil (trade name: SH28PA, manufactured by Dow Corning Toray Co., Ltd.) serving as a leveling agent was added to the dispersion liquid so that its addition amount became 0.01 mass % with respect to the total mass of the metal oxide particles and the binder material in the dispersion liquid, followed by stirring. Thus, a coating liquid for an undercoat layer was prepared. The coating liquid for an undercoat layer was applied onto the support by immersion, and the resultant coating film was dried and thermally cured for 30 minutes at 150° C. to form an undercoat layer having a thickness of 30 μm.

[Intermediate Layer]

Next, 5 parts of Exemplified Compound 101 (electron transporting material) obtained in Synthesis Example 1, 8.6 parts of a blocked isocyanate compound (trade name: SBN-70D, manufactured by Asahi Kasei Chemicals Corporation), 0.6 part of a polyvinyl acetal resin (trade name: KS-5Z, manufactured by Sekisui Chemical Co., Ltd.), and 0.15 part of zinc(II) hexanoate (trade name: Zinc(II) Hexanoate, manufactured by Mitsuwa Chemicals Co., Ltd.) were dissolved in a mixed solvent of 45 parts of 1-methoxy-2-propanol and parts of tetrahydrofuran. 3.3 Parts of a slurry obtained by dispersing silica particles in isopropanol (trade name: IPA-ST-UP, silica ratio: 15 mass %, manufactured by Nissan Chemical Industries, Ltd.) was added to the solution, and the mixture was stirred.

A coating liquid for an intermediate layer thus obtained was applied onto the support by immersion, and the resultant coating film was heated at 160° C. for 40 minutes to be cured (polymerized). Thus, an intermediate layer having a thickness of 0.6 μm was formed.

(101)

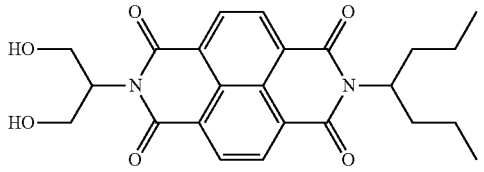

[Charge Generating Layer]

Next, 10 parts of a hydroxygallium phthalocyanine crystal (charge generating material) (phthalocyanine 1) of a crystal form having strong peaks at Bragg angles (2θ±0.2°) in CuKα characteristic X-ray diffraction of 7.5°, 9.9°, 12.5°, 16.3°, 18.6°, 25.1°, and 28.3°, 5 parts of a polyvinyl butyral resin (trade name: S-LEC BX-1, manufactured by Sekisui Chemical Co., Ltd.) (resin 1), and 250 parts of cyclohexanone were loaded into a sand mill using glass beads each having a diameter of 1 mm, and the mixture was subjected to a dispersion treatment for 2 hours. Next, 250 parts of ethyl acetate was added to the resultant to prepare a coating liquid for a charge generating layer.

The coating liquid for a charge generating layer was applied onto the intermediate layer by immersion, and the resultant coating film was dried for 10 minutes at 95° C. to form a charge generating layer having a thickness of 0.17 μm.

[Charge Transporting Layer]

Next, 8 parts of an amine compound represented by the formula (4), and 10 parts of a polyarylate resin having a structural unit represented by the formula (5) and having a weight-average molecular weight Mw of 100,000 were dissolved in a mixed solvent of 40 parts of dimethoxymethane and 60 parts of o-xylene. Thus, a coating liquid for a charge transporting layer was prepared.

(4)

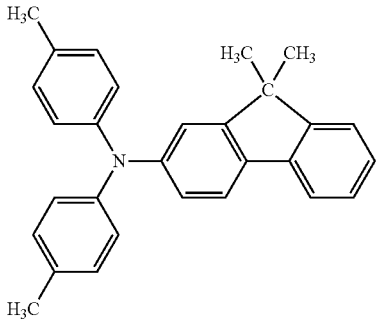

(5)

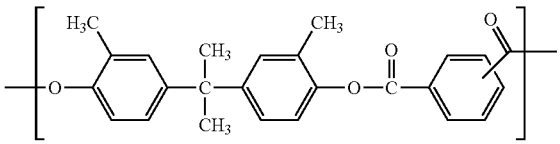

The coating liquid for a charge transporting layer was applied onto the charge generating layer by immersion to form a coating film, and the resultant coating film was dried for 40 minutes at a temperature of 120° C. to form a charge transporting layer having a thickness of 15 μm.

The surface profiles of the support and the intermediate were measured by the following approaches.

<Measurement of Surface Profile of Support>

The intermediate layer and the photosensitive layer laminated on the support of the resultant photosensitive member were removed with solvents capable of dissolving the respective layers.

The surface of the resultant support was observed under magnification with a profile measuring laser microscope (VK-X200, manufactured by Keyence Corporation), and its Rmk(L) was calculated by using the foregoing procedures. The results of the calculation of the Rmk(L) are shown in FIG. 3C and Table 4. In the calculated length range of from 0.1 μm or more to 100 μm or less, the maximum Rmk,max of the Rmk was 0.183 μm, and the calculated length Lm at which the Rmk,max was expressed was 32.392 μm. In addition, the Rmk at a calculated length 0.5 times as long as the Lm, i.e., an Rmk(Lm·0.5) was 0.156 μm, and the Rmk at a calculated length 1.5 times as long as the Lm, i.e., an Rmk(Lm·1.5) was 0.164 μm.

<Measurement of Surface Profile of Intermediate Layer>

The photosensitive layer laminated on the intermediate layer of the resultant photosensitive member was removed with a solvent that did not dissolve or swell the intermediate layer, and was capable of dissolving the photosensitive layer.

The surface of the resultant intermediate layer was observed in the same manner as in the section <Measurement of Surface Profile of Support>, and its Rmk(L) was calculated. The results of the calculation of the Rmk(L) are shown in FIG. 3D and Table 5. In the calculated length range of from 0.1 μm or more to 100 μm or less, the maximum Rmk,max of the Rmk was 0.149 μm, and the calculated length Lm at which the Rmk,max was expressed was 40.102 μm. In addition, the Rmk at a calculated length 0.5 times as long as the Lm, i.e., the Rmk(Lm·0.5) was 0.125 μm, and the Rmk at a calculated length 1.5 times as long as the Lm, i.e., the Rmk(Lm·1.5) was 0.135 μm.

The number-average particle diameter and content of the particles in the intermediate layer were measured by the following approach.

<Measurement of Number-average Particle Diameter of Particles>

The resultant photosensitive member was thinned so that a section appeared, and then the intermediate layer was observed under magnification with a transmission electron microscope (JEM-2800, manufactured by JEOL Ltd.). A number-average particle diameter was determined by measuring the long diameters of the primary particles of 20 particles randomly selected from the resultant observation image. A magnification was appropriately adjusted. The result is shown in Table 5.

<Evaluation>

The electrophotographic photosensitive member was mounted onto a reconstructed apparatus of a laser beam printer manufactured by Canon Inc. (trade name: LBP-2510) (pre-exposure off, primary charging: roller contact DC charging, process speed: 120 mm/sec, laser exposure) under an environment having a temperature of 15° C. and a humidity of 10% RH. Then, the evaluation of output images was performed. Details about the foregoing are as described below.

(Evaluation for Positive Ghost)

The produced electrophotographic photosensitive member was mounted onto the process cartridge for a cyan color of the laser beam printer. The process cartridge was mounted onto the station of the cyan process cartridge, and an image was output. First, 1 solid white image, 5 images for a ghost evaluation, 1 solid black image, and 5 images for a ghost evaluation were continuously output in the stated order.

Next, a full-color image (letter image having a print percentage of each color of 1%) was output on 5,000 sheets, 10,000 sheets, and 15,000 sheets of A4 size plain paper. After that, 1 solid white image, 5 images for a ghost evaluation, 1 solid black image, and 5 images for a ghost evaluation were continuously output in the stated order.

The images for a ghost evaluation are each obtained by producing a one-dot knight-jump pattern halftone image after the output of a quadrangular solid image in a white image in the front portion of an image. The following ghost portion is a portion in which a ghost resulting from the solid image may appear.

An evaluation for a positive ghost was performed by measuring a density difference between the image density of the one-dot knight-jump pattern halftone image and the image density of the ghost portion. Density differences were measured at 10 points in 1 image for a ghost evaluation with a spectral densitometer (trade name: X-Rite 504/508, manufactured by X-Rite). The operation was performed for all of the 10 images for a ghost evaluation, and a Macbeth density difference (initial) at the time of the output of an initial image was evaluated by calculating the average of density differences measured at a total of 100 points. Next, a fluctuation in Macbeth density difference was determined by calculating a difference (change) between a Macbeth density difference after the output on 5,000 sheets, 10,000 sheets, or 15,000 sheets and the Macbeth density difference at the time of the output of the initial image. A smaller Macbeth density difference means that the positive ghost is suppressed to a larger extent. In addition, a smaller difference between the Macbeth density difference after the output and the Macbeth density difference at the time of the output of the initial image means that a fluctuation in positive ghost is smaller. In addition, as an evaluation for adhesiveness between the intermediate layer and the charge generating layer after repeated use of the electrophotographic photosensitive member, the external appearance of the electrophotographic photosensitive member was observed. The results are shown in Table 6.

EXAMPLES 2 to 32

Electrophotographic photosensitive members were each produced in the same manner as in Example 1 except that the kinds and amounts of the compound (electron transporting material) represented by the formula (1) and the particles to be mixed in the coating liquid for an intermediate layer, and the thickness of the intermediate layer were changed as shown in Table 5, and the electrophotographic photosensitive members were evaluated in the same manner as in Example 1. The results are shown in Table 5 and Table 6.

EXAMPLE 33

An electrophotographic photosensitive member was produced and evaluated in the same manner as in Example 1 except that the amount of the slurry obtained by dispersing the silica particles in isopropanol to be mixed in the coating liquid for an intermediate layer was changed to 0.5 part. The results are shown in Table 5 and Table 6.

EXAMPLE 34

An electrophotographic photosensitive member was produced and evaluated in the same manner as in Example 1 except that the amount of the slurry obtained by dispersing the silica particles in isopropanol to be mixed in the coating liquid for an intermediate layer was changed to 8.8 parts. The results are shown in Table 5 and Table 6.

EXAMPLE 35

An electrophotographic photosensitive member was produced and evaluated in the same manner as in Example 1 except that the slurry obtained by dispersing the silica particles in isopropanol to be mixed in the coating liquid for an intermediate layer was changed to 1.7 parts of a slurry obtained by dispersing silica particles in isopropanol (trade name: IPA-ST, silica ratio: 30 mass %, manufactured by Nissan Chemical Industries, Ltd.). The results are shown in Table 5 and Table 6.

EXAMPLE 36

An electrophotographic photosensitive member was produced and evaluated in the same manner as in Example 1 except that: the slurry obtained by dispersing the silica particles in isopropanol to be mixed in the coating liquid for an intermediate layer was changed to 2 parts of powdery alumina particles (trade name: LS-231, manufactured by Nippon Light Metal Co., Ltd.); and glass beads each having a diameter of 0.8 mm were added and stirring was performed with a paint shaker for 3 hours, followed by the removal of the glass beads. The results are shown in Table 5 and Table 6.

EXAMPLE 37

An electrophotographic photosensitive member was produced and evaluated in the same manner as in Example 1 except that: the slurry obtained by dispersing the silica particles in isopropanol to be mixed in the coating liquid for an intermediate layer was changed to 2.1 parts of powdery titanium oxide particles (trade name: TTO-S-4, manufactured by Ishihara Sangyo Kaisha, Ltd.); and glass beads each having a diameter of 0.8 mm were added and stirring was performed with a paint shaker for 3 hours, followed by the removal of the glass beads. The results are shown in Table 5 and Table 6.

EXAMPLE 38

An electrophotographic photosensitive member was produced and evaluated in the same manner as in Example 1 except that: the slurry obtained by dispersing the silica particles in isopropanol to be mixed in the coating liquid for an intermediate layer was changed to 2.7 parts of powdery zinc oxide particles (trade name: ZnO-650, manufactured by Sumitomo Osaka Cement Co., Ltd.); and glass beads each having a diameter of 0.8 mm were added and stirring was performed with a paint shaker for 3 hours, followed by the removal of the glass beads. The results are shown in Table 5 and Table 6.

EXAMPLE 39

An electrophotographic photosensitive member was produced and evaluated in the same manner as in Example 1 except that: the slurry obtained by dispersing the silica particles in isopropanol was not mixed in the coating liquid for an intermediate layer; and the thickness of the intermediate layer was changed to 0.4 μm. The results are shown in Table 5 and Table 6.

EXAMPLE 40

An electrophotographic photosensitive member was produced and evaluated in the same manner as in Example 1 except that the charge generating material to be mixed in the coating liquid for a charge generating layer was changed to an oxytitanium phthalocyanine crystal (phthalocyanine 2) of a crystal form having strong peaks at Bragg angles (2θ±0.2°) in CuKα characteristic X-ray diffraction of 9.5°, 9.7°, 11.7°, 15.0°, 23.5°, 24.1°, and 27.3°. The results are shown in Table 5 and Table 6.

EXAMPLE 41

An electrophotographic photosensitive member was produced and evaluated in the same manner as in Example 1 except that the charge generating material to be mixed in the coating liquid for a charge generating layer was changed to a chlorogallium phthalocyanine crystal (phthalocyanine 3) of a crystal form having peaks at Bragg angles (2θ±0.2°) in CuKα characteristic X-ray diffraction of 8.7°, 9.2°, 17.6°, 24.0°, 27.4°, and 28.8°. The results are shown in Table 5 and Table 6.

EXAMPLE 42

An electrophotographic photosensitive member was produced and evaluated in the same manner as in Example 1 except that the polyvinyl butyral resin to be mixed in the coating liquid for a charge generating layer was changed to a polyvinyl acetal resin (trade name: KS-1, manufactured by Sekisui Chemical Co., Ltd.) (resin 2). The results are shown in Table 5 and Table 6.

EXAMPLE 43

An electrophotographic photosensitive member was produced and evaluated in the same manner as in Example 1 except that the polyvinyl butyral resin to be mixed in the coating liquid for a charge generating layer was changed to a poly-p-vinylphenol resin (trade name: MARUKA LYNCUR M, manufactured by Maruzen Petrochemical Co., Ltd.) (resin 3). The results are shown in Table 5 and Table 6.

EXAMPLE 44

An electrophotographic photosensitive member was produced and evaluated in the same manner as in Example 1 except that the polyvinyl butyral resin to be mixed in the coating liquid for a charge generating layer was changed to a poly-p-vinylphenol resin copolymer (trade name: MARUKA LYNCUR CST, manufactured by Maruzen Petrochemical Co., Ltd.) (resin 4). The results are shown in Table 5 and Table 6.

EXAMPLE 45

An electrophotographic photosensitive member was produced and evaluated in the same manner as in Example 1 except that the polyvinyl butyral resin to be mixed in the coating liquid for a charge generating layer was changed to a poly-p-vinylphenol resin copolymer (trade name: MARUKA LYNCUR CMM, manufactured by Maruzen Petrochemical Co., Ltd.) (resin 5). The results are shown in Table 5 and Table 6.

EXAMPLE 46

An electrophotographic photosensitive member was produced and evaluated in the same manner as in Example 1 except that a support obtained as follows (support 3) was used: the addition amount of the silicone resin particles in the undercoat layer was changed to 5 mass % with respect to the total mass of the metal oxide particles and the binder material in the dispersion liquid after the removal of the glass beads. The results are shown in Table 5 and Table 6.

EXAMPLE 47

An electrophotographic photosensitive member was produced and evaluated in the same manner as in Example 1 except that a support obtained as follows (support 4) was used: the undercoat layer was not arranged on the support 1 and irregular portions were formed on the support with a wet honing treatment apparatus (manufactured by Fujiseiki Corporation) under the following conditions. The results are shown in Table 5 and Table 6.

<Liquid Honing Conditions>

Abrasive grains of abrasive: spherical alumina beads (trade name: CB-A30S, manufactured by Showa Denko K.K.)

| | |
|---|---|
| Suspension medium: | water |
| Abrasive/suspension medium: | 1/9 (volume ratio) |
| Number of revolutions of aluminum tube: | 1.67 $s^{-1}$ |
| Air blowing pressure: | 0.15 MPa |
| Gun moving speed: | 13.3 mm/s |
| Distance between gun nozzle and aluminum tube: | 190 mm |
| Angle at which honing abrasive grains are ejected: | 45° |
| Number of times of delivery of abrasive liquid: | once |

The surface of the resultant support 4 was observed under magnification with a profile measuring laser microscope (VK-X200, manufactured by Keyence Corporation), and its Rmk(L) was calculated by using the foregoing procedures.

Figure 3A:
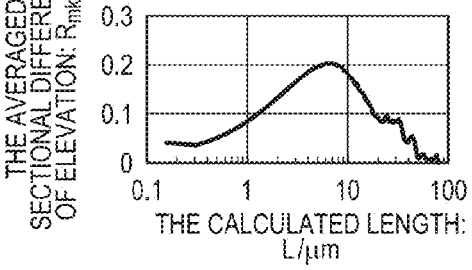
FIG. 3A is a graph obtained by graphing the Rmk(L) calculated from the surface profile of a support against the logarithm of the L.
Figure 3B:
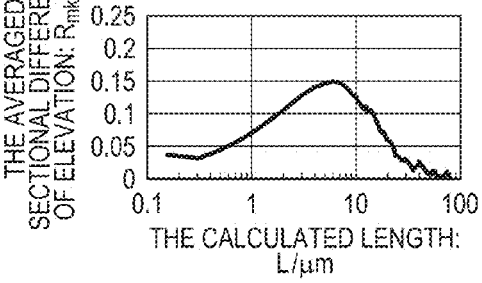
FIG. 3B is a graph obtained by graphing the Rmk(L) calculated from the surface profile of an intermediate layer against the logarithm of the L.
Figure 3C:
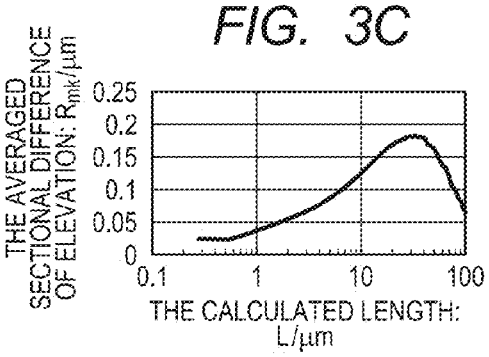
FIG. 3C is a graph obtained by graphing the Rmk(L) calculated from the surface profile of a support having formed thereon an undercoat layer against the logarithm of the L.
Figure 3D:
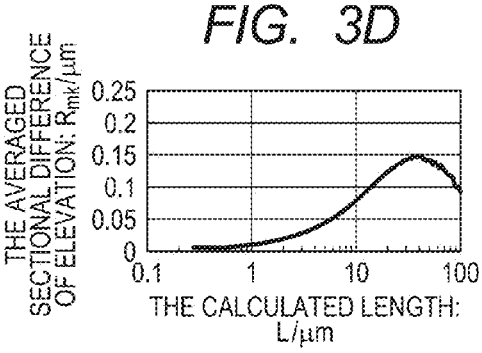
FIG. 3D is a graph obtained by graphing the Rmk(L) calculated from the surface profile of an intermediate layer against the logarithm of the L.

The results of the calculation of the Rmk(L) are shown in FIG. 3A and Table 4. In addition, the results of the calculation of the Rmk(L) of the intermediate layer of the resultant photosensitive member are shown in FIG. 3B and Table 5.

EXAMPLE 48

An electrophotographic photosensitive member was produced and evaluated in the same manner as in Example 1 except that: the undercoat layer was not arranged on the aluminum cylinder (support 1); and the solvent of the intermediate layer was changed to a mixed solvent of 45 parts of 1-propanol and 45 parts of tetrahydrofuran. The results are shown in Table 5 and Table 6.

EXAMPLE 49

An electrophotographic photosensitive member was produced and evaluated in the same manner as in Example 1 except that: the undercoat layer was not arranged on the aluminum cylinder (support 1); and the solvent of the intermediate layer was changed to a mixed solvent of 45 parts of 2-propanol and 45 parts of tetrahydrofuran. The results are shown in Table 5 and Table 6.

COMPARATIVE EXAMPLE 1

An electrophotographic photosensitive member was produced and evaluated in the same manner as in Example 1 except that the electron transporting material to be mixed in the coating liquid for an intermediate layer was changed to a compound represented by the formula (6). The results are shown in Table 7 and Table 8.

(6)

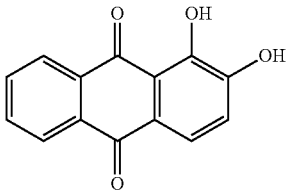

COMPARATIVE EXAMPLE 2

Figure 3E:
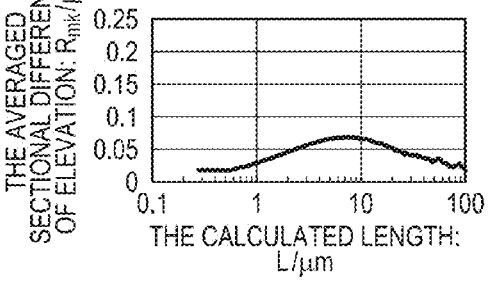
FIG. 3E is a graph obtained by graphing the Rmk(L) calculated from the surface profile of a support against the logarithm of the L.
Figure 3F:
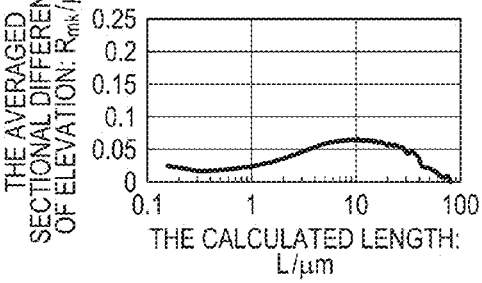
FIG. 3F is a graph obtained by graphing the Rmk(L) calculated from the surface profile of a support having formed thereon an undercoat layer against the logarithm of the L.

An electrophotographic photosensitive member was produced and evaluated in the same manner as in Example 1 except that: the undercoat layer was not arranged on the aluminum cylinder (support 1); and the slurry obtained by dispersing the silica particles in isopropanol was not mixed in the coating liquid for an intermediate layer. The results are shown in Table 7 and Table 8. The surface of the support 1 was observed under magnification with a profile measuring laser microscope (VK-X200, manufactured by Keyence Corporation), and its Rmk(L) was calculated by using the foregoing procedures. The results of the calculation of the Rmk(L) are shown in FIG. 3E and Table 5. In addition, the results of the calculation of the Rmk(L) of the intermediate layer of the resultant photosensitive member are shown in FIG. 3F and Table 5.

COMPARATIVE EXAMPLES 3 and 4

Electrophotographic photosensitive members were each produced and evaluated in the same manner as in Comparative Example 2 except that the electron transporting material to be mixed in the coating liquid for an intermediate layer was changed as shown in Table 7. The results are shown in Table 7 and Table 8.

COMPARATIVE EXAMPLE 5

An electrophotographic photosensitive member was produced and evaluated in the same manner as in Example 1 except that the charge generating material to be mixed in the coating liquid for a charge generating layer was changed to a compound (7) represented by the formula (7). The results are shown in Table 7 and Table 8.

(7)

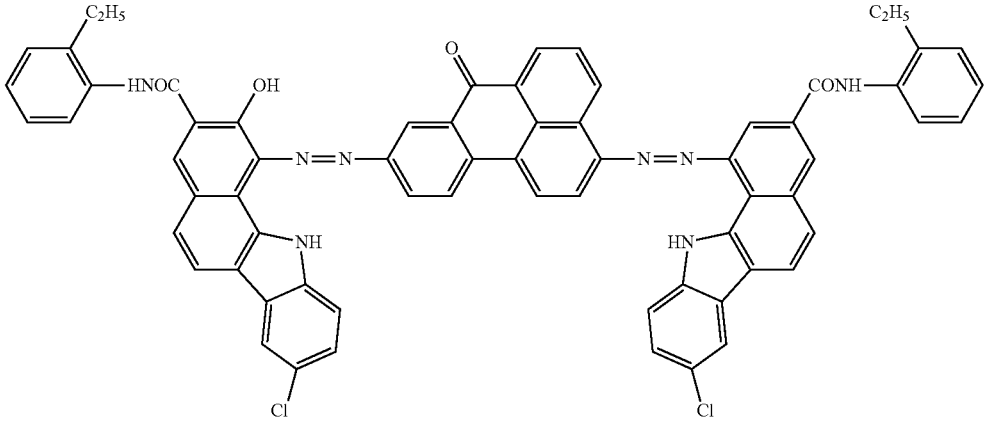

COMPARATIVE EXAMPLE 6

An electrophotographic photosensitive member was produced in the same manner as in Example 1 except that the following coating liquid for an intermediate layer was used, and the electrophotographic photosensitive member was evaluated in the same manner as in Example 1. The results are shown in Table 7 and Table 8.

10 Parts of a compound represented by the following formula (8) and 5 parts of a phenol resin (PL-4804, manufactured by Gun Ei Chemical Industry Co., Ltd.) were dissolved in a mixed solvent of 200 parts of dimethylformamide and 150 parts of benzyl alcohol. Thus, the coating liquid for an intermediate layer was prepared.

(8)

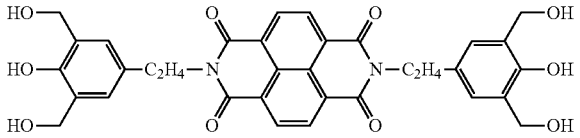

COMPARATIVE EXAMPLE 7

An electrophotographic photosensitive member was produced in the same manner as in Example 1 except that the following coating liquid for an intermediate layer was used, and the electrophotographic photosensitive member was evaluated in the same manner as in Example 1. The results are shown in Table 7 and Table 8.

10 Parts of a compound represented by the following formula (9), 0.15 part of zinc(II) octylate, and 3 parts of a polyvinyl acetal resin (trade name: KS-5Z, manufactured by Sekisui Chemical Co., Ltd.) were dissolved in a mixed solvent of 250 parts of 1-methoxy-2-propanol and 250 parts of tetrahydrofuran. Thus, the coating liquid for an intermediate layer was prepared.

(9)

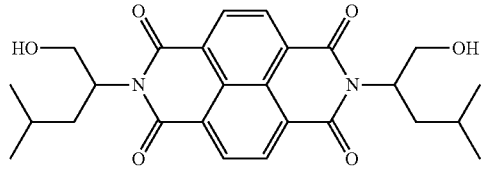

COMPARATIVE EXAMPLE 8

An electrophotographic photosensitive member was produced in the same manner as in Example 1 except that the following coating liquid for an intermediate layer was used, and the electrophotographic photosensitive member was evaluated in the same manner as in Example 1. The results are shown in Table 7 and Table 8.

4 Parts of a compound represented by the following formula (10), 0.08 part of zinc(II) hexanoate, and 0.54 part of a polyvinyl acetal resin (trade name: KS-5Z, manufactured by Sekisui Chemical Co., Ltd.) were dissolved in a mixed solvent of 60 parts of dimethylacetamide and 60 parts of methyl ethyl ketone. Thus, the coating liquid for an intermediate layer was prepared.

(10)

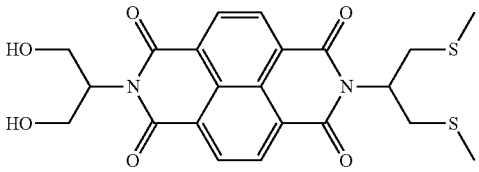

TABLE 4

| Support | Rmk, max (μm) | Lm (μm) | Rmk (Lm · 0.5) (μm) | Rmk (Lm ·1.5) (μm) |
|---|---|---|---|---|
| Support 1 | 0.069 | 7.198 | 0.060 | 0.066 |
| Support 2 | 0.183 | 32.392 | 0.156 | 0.164 |
| Support 3 | 0.133 | 31.564 | 0.105 | 0.112 |
| Support 4 | 0.203 | 7.031 | 0.177 | 0.174 |

TABLE 5

| | | Intermediate layer | | | | | | | | Charge generating layer | |
|---|---|---|---|---|---|---|---|---|---|---|---|
| Example | Support | Electron transporting material | Particles | Particle diameter (μm) | Thickness (μm) | Rmk, max (μm) | Lm (μm) | Rmk (Lm · 0.5) (μm) | Rmk (Lm · 1.5) (μm) | Charge generating material | Resin |
| 1 | Support 2 | 101 | Silica | 0.06 | 0.6 | 0.149 | 40.102 | 0.125 | 0.130 | Phthalocyanine 1 | Resin 1 |
| 2 | Support 2 | 102 | Silica | 0.06 | 0.6 | 0.112 | 40.024 | 0.091 | 0.096 | Phthalocyanine 1 | Resin 1 |
| 3 | Support 2 | 108 | Silica | 0.06 | 0.6 | 0.102 | 39.866 | 0.082 | 0.085 | Phthalocyanine 1 | Resin 1 |
| 4 | Support 2 | 113 | Silica | 0.06 | 1.0 | 0.088 | 38.566 | 0.068 | 0.070 | Phthalocyanine 1 | Resin 1 |
| 5 | Support 2 | 114 | Silica | 0.06 | 1.0 | 0.079 | 39.553 | 0.058 | 0.060 | Phthalocyanine 1 | Resin 1 |
| 6 | Support 2 | 101 | Silica | 0.06 | 0.6 | 0.133 | 38.774 | 0.114 | 0.112 | Phthalocyanine 1 | Resin 1 |
| 7 | Support 2 | 117 | Silica | 0.06 | 0.6 | 0.101 | 40.304 | 0.084 | 0.090 | Phthalocyanine 1 | Resin 1 |
| 8 | Support 2 | 122 | Silica | 0.06 | 0.6 | 0.124 | 39.125 | 0.104 | 0.109 | Phthalocyanine 1 | Resin 1 |
| 9 | Support 2 | 124 | Silica | 0.06 | 0.6 | 0.148 | 41.224 | 0.106 | 0.110 | Phthalocyanine 1 | Resin 1 |
| 10 | Support 2 | 101/117 | Silica | 0.06 | 0.6 | 0.137 | 38.442 | 0.117 | 0.115 | Phthalocyanine 1 | Resin 1 |
| 11 | Support 2 | 125 | Silica | 0.06 | 0.6 | 0.145 | 40.224 | 0.125 | 0.123 | Phthalocyanine 1 | Resin 1 |
| 12 | Support 2 | 126 | Silica | 0.06 | 0.6 | 0.155 | 40.356 | 0.131 | 0.128 | Phthalocyanine 1 | Resin 1 |
| 13 | Support 2 | 127 | Silica | 0.06 | 0.6 | 0.152 | 39.166 | 0.129 | 0.126 | Phthalocyanine 1 | Resin 1 |
| 14 | Support 2 | 128 | Silica | 0.06 | 0.6 | 0.097 | 38.333 | 0.074 | 0.078 | Phthalocyanine 1 | Resin 1 |
| 15 | Support 2 | 129 | Silica | 0.06 | 0.6 | 0.118 | 41.442 | 0.099 | 0.105 | Phthalocyanine 1 | Resin 1 |
| 16 | Support 2 | 130 | Silica | 0.06 | 0.6 | 0.132 | 38.362 | 0.114 | 0.110 | Phthalocyanine 1 | Resin 1 |
| 17 | Support 2 | 132 | Silica | 0.06 | 0.6 | 0.111 | 41.224 | 0.094 | 0.098 | Phthalocyanine 1 | Resin 1 |

TABLE 5-continued

| | | Intermediate layer | | | | | | | | Charge generating layer | |
|---|---|---|---|---|---|---|---|---|---|---|---|
| Example | Support | Electron transporting material | Particles | Particle diameter (μm) | Thickness (μm) | Rmk, max (μm) | Lm (μm) | Rmk (Lm · 0.5) (μm) | Rmk (Lm · 1.5) (μm) | Charge generating material | Resin |
| 18 | Support 2 | 134 | Silica | 0.06 | 0.6 | 0.117 | 37.894 | 0.096 | 0.100 | Phthalocyanine 1 | Resin 1 |
| 19 | Support 2 | 140 | Silica | 0.06 | 0.6 | 0.135 | 41.223 | 0.114 | 0.111 | Phthalocyanine 1 | Resin 1 |
| 20 | Support 2 | 141 | Silica | 0.06 | 0.6 | 0.125 | 38.747 | 0.104 | 0.107 | Phthalocyanine 1 | Resin 1 |
| 21 | Support 2 | 201 | Silica | 0.06 | 0.6 | 0.122 | 38.254 | 0.124 | 0.122 | Phthalocyanine 1 | Resin 1 |
| 22 | Support 2 | 203 | Silica | 0.06 | 0.6 | 0.141 | 38.133 | 0.120 | 0.121 | Phthalocyanine 1 | Resin 1 |
| 23 | Support 2 | 205 | Silica | 0.06 | 0.6 | 0.118 | 37.224 | 0.099 | 0.103 | Phthalocyanine 1 | Resin 1 |
| 24 | Support 2 | 208 | Silica | 0.06 | 0.6 | 0.131 | 36.984 | 0.124 | 0.119 | Phthalocyanine 1 | Resin 1 |
| 25 | Support 2 | 212 | Silica | 0.06 | 0.6 | 0.149 | 37.166 | 0.129 | 0.127 | Phthalocyanine 1 | Resin 1 |
| 26 | Support 2 | 213 | Silica | 0.06 | 0.6 | 0.142 | 36.881 | 0.123 | 0.125 | Phthalocyanine 1 | Resin 1 |
| 27 | Support 2 | 215 | Silica | 0.06 | 0.6 | 0.095 | 36.752 | 0.076 | 0.079 | Phthalocyanine 1 | Resin 1 |
| 28 | Support 2 | 216 | Silica | 0.06 | 0.6 | 0.102 | 37.111 | 0.084 | 0.087 | Phthalocyanine 1 | Resin 1 |
| 29 | Support 2 | 218 | Silica | 0.06 | 0.6 | 0.148 | 36.955 | 0.128 | 0.125 | Phthalocyanine 1 | Resin 1 |
| 30 | Support 2 | 237 | Silica | 0.06 | 0.6 | 0.139 | 36.446 | 0.118 | 0.120 | Phthalocyanine 1 | Resin 1 |
| 31 | Support 2 | 101 | Silica | 0.06 | 0.3 | 0.151 | 40.145 | 0.128 | 0.130 | Phthalocyanine 1 | Resin 1 |
| 32 | Support 2 | 101 | Silica | 0.06 | 2.0 | 0.121 | 41.227 | 0.104 | 0.107 | Phthalocyanine 1 | Resin 1 |
| 33 | Support 2 | 101 | Silica | 0.06 | 0.6 | 0.076 | 40.353 | 0.056 | 0.062 | Phthalocyanine 1 | Resin 1 |
| 34 | Support 2 | 101 | Silica | 0.06 | 0.6 | 0.163 | 40.577 | 0.136 | 0.133 | Phthalocyanine 1 | Resin 1 |
| 35 | Support 2 | 101 | Silica | 0.01 | 0.6 | 0.109 | 39.348 | 0.088 | 0.092 | Phthalocyanine 1 | Resin 1 |
| 36 | Support 2 | 101 | Alumina | 0.1 | 0.6 | 0.144 | 41.899 | 0.124 | 0.119 | Phthalocyanine 1 | Resin 1 |
| 37 | Support 2 | 101 | Titanium oxide | 0.07 | 0.6 | 0.155 | 41.150 | 0.134 | 0.129 | Phthalocyanine 1 | Resin 1 |
| 38 | Support 2 | 101 | Zinc oxide | 0.03 | 0.6 | 0.123 | 38.550 | 0.104 | 0.102 | Phthalocyanine 1 | Resin 1 |
| 39 | Support 2 | 101 | — | — | 0.4 | 0.133 | 40.151 | 0.114 | 0.113 | Phthalocyanine 1 | Resin 1 |
| 40 | Support 2 | 101 | Silica | 0.06 | 0.6 | 0.147 | 40.002 | 0.127 | 0.124 | Phthalocyanine 2 | Resin 1 |
| 41 | Support 2 | 101 | Silica | 0.06 | 0.6 | 0.148 | 39.853 | 0.123 | 0.122 | Phthalocyanine 3 | Resin 1 |
| 42 | Support 2 | 101 | Silica | 0.06 | 0.6 | 0.145 | 39.242 | 0.124 | 0.121 | Phthalocyanine 1 | Resin 2 |
| 43 | Support 2 | 101 | Silica | 0.06 | 0.6 | 0.138 | 38.332 | 0.114 | 0.117 | Phthalocyanine 1 | Resin 3 |
| 44 | Support 2 | 101 | Silica | 0.06 | 0.6 | 0.139 | 40.313 | 0.119 | 0.114 | Phthalocyanine 1 | Resin 4 |
| 45 | Support 2 | 101 | Silica | 0.06 | 0.6 | 0.129 | 37.663 | 0.109 | 0.108 | Phthalocyanine 1 | Resin 5 |
| 46 | Support 3 | 101 | Silica | 0.06 | 0.6 | 0.111 | 38.776 | 0.090 | 0.095 | Phthalocyanine 1 | Resin 1 |
| 47 | Support 4 | 101 | Silica | 0.06 | 0.6 | 0.099 | 6.057 | 0.077 | 0.081 | Phthalocyanine 1 | Resin 1 |
| 48 | Support 1 | 101 | Silica | 0.06 | 0.6 | 0.102 | 6.159 | 0.084 | 0.091 | Phthalocyanine 1 | Resin 1 |
| 49 | Support 1 | 101 | Silica | 0.06 | 0.6 | 0.087 | 6.060 | 0.064 | 0.071 | Phthalocyanine 1 | Resin 1 |

In Table 5, the column "Charge transporting material" shows the kind of the charge transporting material to be incorporated into the intermediate layer. The column "Particles" shows the kind of the particles to be incorporated into the intermediate layer. The column "Particle diameter" shows the number-average particle diameter of the particles determined in the section <Measurement of Number-average Particle Diameter of Particles>. The column "Charge generating material" shows the kind of the charge generating material to be incorporated into the charge generating layer. The column "Resin" shows the kind of the resin to be incorporated into the charge generating layer.

TABLE 6

| | | Durability test | | | | | |
|---|---|---|---|---|---|---|---|
| | | 5,000 sheets | | 10,000 sheets | | 15,000 sheets | |
| Example | Initial density | Density difference | Peeling | Density difference | Peeling | Density difference | Peeling |
| 1 | 0.025 | 0.005 | Absent | 0.011 | Absent | 0.016 | Absent |
| 2 | 0.022 | 0.003 | Absent | 0.008 | Absent | 0.015 | Absent |
| 3 | 0.027 | 0.007 | Absent | 0.010 | Absent | 0.015 | Absent |
| 4 | 0.028 | 0.005 | Absent | 0.013 | Absent | 0.016 | Absent |
| 5 | 0.028 | 0.002 | Absent | 0.009 | Absent | 0.014 | Absent |
| 6 | 0.025 | 0.005 | Absent | 0.012 | Absent | 0.016 | Absent |
| 7 | 0.022 | 0.003 | Absent | 0.007 | Absent | 0.014 | Absent |
| 8 | 0.027 | 0.007 | Absent | 0.010 | Absent | 0.015 | Absent |
| 9 | 0.022 | 0.006 | Absent | 0.010 | Absent | 0.016 | Absent |
| 10 | 0.020 | 0.003 | Absent | 0.007 | Absent | 0.013 | Absent |
| 11 | 0.025 | 0.005 | Absent | 0.008 | Absent | 0.017 | Absent |
| 12 | 0.022 | 0.003 | Absent | 0.008 | Absent | 0.013 | Absent |
| 13 | 0.027 | 0.004 | Absent | 0.011 | Absent | 0.014 | Absent |
| 14 | 0.028 | 0.008 | Absent | 0.012 | Absent | 0.015 | Absent |
| 15 | 0.020 | 0.002 | Absent | 0.009 | Absent | 0.014 | Absent |
| 16 | 0.027 | 0.007 | Absent | 0.011 | Absent | 0.016 | Absent |
| 17 | 0.021 | 0.005 | Absent | 0.010 | Absent | 0.015 | Absent |
| 18 | 0.020 | 0.002 | Absent | 0.007 | Absent | 0.015 | Absent |
| 19 | 0.023 | 0.003 | Absent | 0.009 | Absent | 0.017 | Absent |
| 20 | 0.023 | 0.002 | Absent | 0.008 | Absent | 0.014 | Absent |
| 21 | 0.025 | 0.009 | Absent | 0.016 | Absent | 0.020 | Absent |

TABLE 6-continued

| | | Durability test | | | | | |
|---|---|---|---|---|---|---|---|
| | | 5,000 sheets | | 10,000 sheets | | 15,000 sheets | |
| Example | Initial density | Density difference | Peeling | Density difference | Peeling | Density difference | Peeling |
| 22 | 0.028 | 0.013 | Absent | 0.015 | Absent | 0.023 | Absent |
| 23 | 0.029 | 0.010 | Absent | 0.016 | Absent | 0.021 | Absent |
| 24 | 0.025 | 0.009 | Absent | 0.015 | Absent | 0.025 | Absent |
| 25 | 0.024 | 0.011 | Absent | 0.013 | Absent | 0.024 | Absent |
| 26 | 0.025 | 0.012 | Absent | 0.015 | Absent | 0.021 | Absent |
| 27 | 0.022 | 0.009 | Absent | 0.016 | Absent | 0.022 | Absent |
| 28 | 0.027 | 0.012 | Absent | 0.016 | Absent | 0.023 | Absent |
| 29 | 0.035 | 0.009 | Absent | 0.015 | Absent | 0.023 | Absent |
| 30 | 0.020 | 0.013 | Absent | 0.016 | Absent | 0.025 | Absent |
| 31 | 0.029 | 0.015 | Absent | 0.042 | Absent | 0.057 | Absent |
| 32 | 0.030 | 0.016 | Absent | 0.039 | Absent | 0.055 | Absent |
| 33 | 0.025 | 0.013 | Absent | 0.047 | Absent | 0.058 | Absent |
| 34 | 0.026 | 0.008 | Absent | 0.010 | Absent | 0.017 | Absent |
| 35 | 0.026 | 0.007 | Absent | 0.011 | Absent | 0.015 | Absent |
| 36 | 0.024 | 0.002 | Absent | 0.008 | Absent | 0.015 | Absent |
| 37 | 0.023 | 0.007 | Absent | 0.011 | Absent | 0.015 | Absent |
| 38 | 0.023 | 0.004 | Absent | 0.011 | Absent | 0.016 | Absent |
| 39 | 0.029 | 0.015 | Absent | 0.044 | Absent | 0.055 | Absent |
| 40 | 0.028 | 0.008 | Absent | 0.013 | Absent | 0.016 | Absent |
| 41 | 0.025 | 0.006 | Absent | 0.009 | Absent | 0.015 | Absent |
| 42 | 0.026 | 0.007 | Absent | 0.012 | Absent | 0.016 | Absent |
| 43 | 0.016 | 0.003 | Absent | 0.011 | Absent | 0.013 | Absent |
| 44 | 0.017 | 0.004 | Absent | 0.009 | Absent | 0.012 | Absent |
| 45 | 0.017 | 0.002 | Absent | 0.008 | Absent | 0.013 | Absent |
| 46 | 0.029 | 0.010 | Absent | 0.051 | Absent | 0.059 | Absent |
| 47 | 0.021 | 0.005 | Absent | 0.010 | Absent | 0.016 | Absent |
| 48 | 0.027 | 0.016 | Absent | 0.048 | Absent | 0.056 | Absent |
| 49 | 0.029 | 0.015 | Absent | 0.041 | Absent | 0.057 | Absent |

TABLE 7

| | | Intermediate layer | | | | | | | | Charge generating layer | |
|---|---|---|---|---|---|---|---|---|---|---|---|
| Comparative Example | Support | Electron transporting material | Particles | Particle diameter (μm) | Thickness (μm) | Rmk, max (μm) | Lm (μm) | Rmk (Lm · 0.5) (μm) | Rmk (Lm · 1.5) (μm) | Charge generating material | Resin |
| 1 | Support 2 | Compound (6) | Silica 1 | 0.06 | 0.6 | 0.137 | 37.102 | 0.117 | 0.111 | Phthalocyanine 1 | Resin 1 |
| 2 | Support 1 | 101 | — | — | 0.6 | 0.042 | 7.344 | 0.034 | 0.029 | Phthalocyanine 1 | Resin 1 |
| 3 | Support 1 | 125 | — | — | 0.6 | 0.063 | 8.160 | 0.049 | 0.048 | Phthalocyanine 1 | Resin 1 |
| 4 | Support 1 | 128 | — | — | 0.6 | 0.059 | 6.561 | 0.041 | 0.046 | Phthalocyanine 1 | Resin 1 |
| 5 | Support 2 | 101 | — | — | 0.6 | 0.124 | 38.502 | 0.107 | 0.104 | Compound (7) | Resin 1 |
| 6 | Support 2 | Compound (8) | — | — | 0.6 | 0.056 | 18.344 | 0.046 | 0.042 | Phthalocyanine 1 | Resin 1 |
| 7 | Support 2 | Compound (9) | — | — | 0.6 | 0.083 | 28.402 | 0.054 | 0.045 | Phthalocyanine 1 | Resin 1 |
| 8 | Support 2 | Compound (10) | — | — | 0.6 | 0.085 | 27.601 | 0.050 | 0.042 | Phthalocyanine 1 | Resin 1 |

In Table 7, the column "Charge transporting material" shows the kind of the charge transporting material to be incorporated into the intermediate layer. The column "Particles" shows the kind of the particles to be incorporated into the intermediate layer. The column "Particle diameter" shows the number-average particle diameter of the particles determined in the section <Measurement of Number-average Particle Diameter of Particles>. The column "Charge generating material" shows the kind of the charge generating material to be incorporated into the charge generating layer. The column "Resin" shows the kind of the resin to be incorporated into the charge generating layer.

TABLE 8

| | | Durability test | | | | | |
|---|---|---|---|---|---|---|---|
| Comparative | Initial | 5,000 sheets | | 10,000 sheets | | 15,000 sheets | |
| Example | density | Density difference | Peeling | Density difference | Peeling | Density difference | Peeling |
| 1 | 0.035 | 0.039 | Present | 0.083 | Present | 0.092 | Present |
| 2 | 0.023 | 0.044 | Present | 0.073 | Present | 0.096 | Present |
| 3 | 0.028 | 0.041 | Present | 0.081 | Present | 0.091 | Present |
| 4 | 0.025 | 0.037 | Present | 0.079 | Present | 0.089 | Present |
| 5 | 0.024 | 0.040 | Present | 0.085 | Present | 0.090 | Present |
| 6 | 0.035 | 0.053 | Present | 0.066 | Present | 0.096 | Present |

TABLE 8-continued

| Comparative Example | Initial density | Durability test: 5,000 sheets Density difference | 5,000 sheets Peeling | 10,000 sheets Density difference | 10,000 sheets Peeling | 15,000 sheets Density difference | 15,000 sheets Peeling |
|---|---|---|---|---|---|---|---|
| 7 | 0.026 | 0.015 | Absent | 0.021 | Absent | 0.047 | Present |
| 8 | 0.028 | 0.017 | Absent | 0.020 | Absent | 0.050 | Present |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-127983, filed Jun. 25, 2015, which is hereby incorporated by reference herein in its entirety.

What is claimed is:

1. An electrophotographic photosensitive member, comprising:

a support;

an intermediate layer formed on the support, the intermediate layer containing a polymerized product of a composition containing a compound represented by formula (1);

a charge generating layer formed directly on the intermediate layer, the charge generating layer containing a phthalocyanine pigment and a resin; and a charge transporting layer formed on the charge generating layer, wherein when an averaged sectional difference of elevation in a calculated length range of from 0.1 to 100 μm in a surface of the intermediate layer on a charge generating layer side is measured, in a calculated length range of from 0.5 to 1.5 times of a calculated length at which a maximum of the averaged sectional difference of elevation (Rmk,max) is expressed, a value for the averaged sectional difference of elevation (Rmk) is 0.05 μm or more, where the averaged sectional difference of elevation Rmk is calculated by obtaining three-dimensional surface profile data z(x,y) on the intermediate layer by measuring vertical direction elevation data z(x,y) corresponding to horizontal direction coordinates (x,y), (1) dividing the resultant surface profile data into meshes each having a length of one side of L, (2) averaging the elevations z(x,y) in each mesh having a length of one side of L, (3) calculating in each mesh sectional differences of elevation from differences of elevation from the surrounding meshes, and (4) averaging the resultant sectional differences of elevation over all the meshes, with the resultant value being Rmk (1)

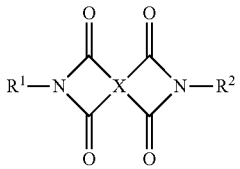

$R^1$ represents (i) an alkyl group having 1 to 6 carbon atoms in a main chain thereof, the alkyl group having 2 or more polymerizable functional groups, (ii) a group derived by substituting at least one $CH_2$ in a main chain of an alkyl group having 3 to 6 carbon atoms in the main chain, the alkyl group having 2 or more polymerizable functional groups, with an oxygen atom, or (iii) a group derived by substituting at least one $CH_2$ in a main chain of an alkyl group having 3 to 6 carbon atoms in the main chain, the alkyl group having 2 or more polymerizable functional groups, with $NR^{17}$, the polymerizable functional groups each comprise a hydroxy group, a thiol group, an amino group, or a carboxyl group, and $R^{17}$ represents a hydrogen atom or an alkyl group having 1 to 4 carbon atoms in a main chain thereof;

$R^2$ represents (i) a substituted or unsubstituted alkyl group having 1 to 6 carbon atoms in a main chain thereof, (ii) a group derived by substituting at least one $CH_2$ in a main chain of a substituted or unsubstituted alkyl group having 3 to 6 carbon atoms in the main chain with an oxygen atom, (iii) a group derived by substituting at least one $CH_2$ in a main chain of a substituted or unsubstituted alkyl group having 3 to 6 carbon atoms in the main chain with $NR^{18}$, (iv) a group derived by substituting at least one $C_2H_4$ in a main chain of a substituted or unsubstituted alkyl group having 3 to 6 carbon atoms in the main chain with COO, or (v) a substituted or unsubstituted aryl group, and $R^{18}$ represents a hydrogen atom or an alkyl group having 1 to 4 carbon atoms in a main chain thereof;

the substituent comprises an alkyl group having 1 to 5 carbon atoms, a benzyl group, an alkoxycarbonyl group, or a phenyl group for each of the alkyl group, the group derived by substituting at least one $CH_2$ in the main chain of the alkyl group with an oxygen atom, the group derived by substituting at least one $CH_2$ in the main chain of the alkyl group with $NR^{17}$, the group derived by substituting at least one $CH_2$ in the main chain of the alkyl group with $NR^{18}$, and the group derived by substituting at least one $C_2H_4$ in the main chain of the alkyl group with COO;

the substituent of the aryl group comprises a halogen atom, a cyano group, a nitro group, a methyl group, an ethyl group, an isopropyl group, a n-propyl group, a n-butyl group, an acyl group, an alkoxy group, an alkoxycarbonyl group, or an aminoalkoxy group; and X represents one structure selected from the formulae (X1), (X2), and (X3):

(X1)

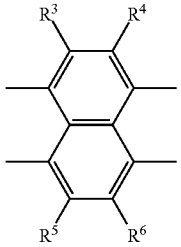

(X2)

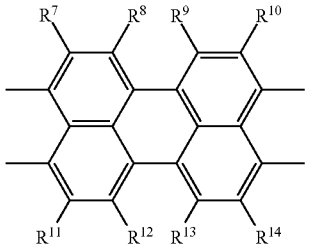

(X3)

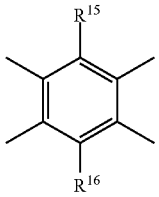

in the formulae (X1) to (X3), $R^3$ to $R^{16}$ each independently represent a hydrogen atom, a halogen atom, a cyano group, a nitro group, a substituted or unsubstituted alkyl group having 1 to 6 carbon atoms in a main chain thereof, or a substituted or unsubstituted aryl group.

2. An electrophotographic photosensitive member according to claim 1, wherein the $R^2$ represents a group represented by the formula (2):

(2)

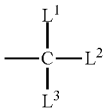

$L^l$ represents a hydrogen atom;

$L^2$ and $L^3$ each independently represent (i) a substituted or unsubstituted alkyl group having 1 to 5 carbon atoms in a main chain thereof, (ii) a group derived by substituting at least one $CH_2$ in a main chain of a substituted or unsubstituted alkyl group having 2 to 5 carbon atoms in the main chain with an oxygen atom, (iii) a group derived by substituting at least one $CH_2$ in a main chain of a substituted or unsubstituted alkyl group having 2 to 5 carbon atoms in the main chain with $NR^{19}$, (iv) a group derived by substituting at least one $C_2H_4$ in a main chain of a substituted or unsubstituted alkyl group having 3 to 5 carbon atoms in the main chain with COO, or (v) a substituted or unsubstituted aryl group;

a substituent of each of the alkyl group, the group derived by substituting at least one $CH_2$ in the main chain of the alkyl group with an oxygen atom, the group derived by substituting at least one $CH_2$ in the main chain of the alkyl group with $NR^{19}$, and the group derived by substituting at least one $C_2H_4$ in the main chain of the alkyl group with COO comprises an alkyl group having 1 to 4 carbon atoms, a benzyl group, an alkoxycarbonyl group, or a phenyl group;

a substituent of the aryl group comprises a halogen atom, a cyano group, a nitro group, a methyl group, an ethyl group, an isopropyl group, a n-propyl group, a n-butyl group, an acyl group, an alkoxy group, an alkoxycarbonyl group, or an aminoalkoxy group; and $R^{19}$ represents a hydrogen atom or an alkyl group having 1 to 3 carbon atoms in a main chain thereof.

3. An electrophotographic photosensitive member according to claim 1, wherein the intermediate layer further contains particles having a number-average particle diameter of 0.2 μm or less.

4. An electrophotographic photosensitive member according to claim 1, wherein in the calculated length range of from 0.5 to 1.5 times of the calculated length at which the maximum of the averaged sectional difference of elevation (Rmk,max) is expressed, the value for the averaged sectional difference of elevation (Rmk) is 0.07 μm or more.

5. An electrophotographic photosensitive member according to claim 1, wherein the resin comprises a resin having at least a structure represented by the formula (3):

(3)

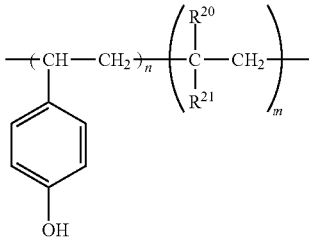

where n represents an integer of 1 or more, m represents an integer of 0 or 1 or more, $R^{20}$ represents a hydrogen atom or a methyl group, and $R^{21}$ represents a methoxycarbonyl group, an ethoxycarbonyl group, a n-propoxycarbonyl group, a n-butoxycarbonyl group, a 2-hydroxyethoxycarbonyl group, a hydroxy group, or a phenyl group.

6. A process cartridge, comprising:

an electrophotographic photosensitive member; and at least one unit selected from the group consisting of a charging unit, a developing unit, a transferring unit, and a cleaning unit, the process cartridge integrally supporting the electrophotographic photosensitive member and the at least one unit, and the process cartridge being removably mounted onto a main body of an electrophotographic apparatus, the electrophotographic photosensitive member comprising:

a support;

an intermediate layer formed on the support, the intermediate layer containing a polymerized product of a composition containing a compound represented by formula (1);

a charge generating layer formed directly on the intermediate layer, the charge generating layer containing a phthalocyanine pigment and a resin; and a charge transporting layer formed on the charge generating layer, wherein when an averaged sectional difference of elevation in a calculated length range of from 0.1 to 100 μm in a surface of the intermediate layer on a charge generating layer side is measured, in a calculated length range of from 0.5 to 1.5 times of a calculated length at which a maximum of the averaged sectional difference of elevation (Rmk,max) is expressed, a value for the averaged sectional difference of elevation (Rmk) is 0.05 μm or more, where the averaged sectional difference of elevation Rmk is calculated by obtaining three-dimensional surface profile data z(x,y) on the intermediate layer by measuring vertical direction elevation data z(x,y) corresponding to horizontal direction coordinates (x,y), (1) dividing the resultant surface profile data into meshes each having a length of one side of L, (2) averaging the elevations z(x,y) in each mesh having a length of one side of L, (3) calculating in each mesh sectional differences of elevation from differences of elevation from the surrounding meshes, and (4) averaging the resultant sectional differences of elevation over all the meshes, with the resultant value being Rmk (1)

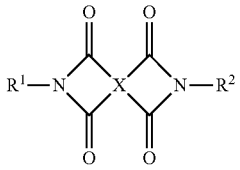

$R^1$ represents (i) an alkyl group having 1 to 6 carbon atoms in a main chain thereof, the alkyl group having 2 or more polymerizable functional groups, (ii) a group derived by substituting at least one $CH_2$ in a main chain of an alkyl group having 3 to 6 carbon atoms in the main chain, the alkyl group having 2 or more polymerizable functional groups, with an oxygen atom, or (iii) a group derived by substituting at least one $CH_2$ in a main chain of an alkyl group having 3 to 6 carbon atoms in the main chain, the alkyl group having 2 or more polymerizable functional groups, with $NR^{17}$, the polymerizable functional groups each comprise a hydroxy group, a thiol group, an amino group, or a carboxyl group, and $R^{17}$ represents a hydrogen atom or an alkyl group having 1 to 4 carbon atoms in a main chain thereof;

$R^2$ represents (i) a substituted or unsubstituted alkyl group having 1 to 6 carbon atoms in a main chain thereof, (ii) a group derived by substituting at least one $CH_2$ in a main chain of a substituted or unsubstituted alkyl group having 3 to 6 carbon atoms in the main chain with an oxygen atom, (iii) a group derived by substituting at least one $CH_2$ in a main chain of a substituted or unsubstituted alkyl group having 3 to 6 carbon atoms in the main chain with $NR^{18}$, (iv) a group derived by substituting at least one $C_2H_4$ in a main chain of a substituted or unsubstituted alkyl group having 3 to 6 carbon atoms in the main chain with COO, or (v) a substituted aryl group, and $R^{18}$ represents a hydrogen atom or an alkyl group having 1 to 4 carbon atoms in a main chain thereof;

the substituent comprises an alkyl group having 1 to 5 carbon atoms, a benzyl group, an alkoxycarbonyl group, or a phenyl group for each of the alkyl group, the group derived by substituting at least one $CH_2$ in the main chain of the alkyl group with an oxygen atom, the group derived by substituting at least one $CH_2$ in the main chain of the alkyl group with $NR^{17}$, the group derived by substituting at least one $CH_2$ in the main chain of the alkyl group with $NR^{18}$, and the group derived by substituting at least one $C_2H_4$ in the main chain of the alkyl group with COO;

the substituent of the aryl group comprises a halogen atom, a cyano group, a nitro group, a methyl group, an ethyl group, an isopropyl group, a n-propyl group, a n-butyl group, an acyl group, an alkoxy group, an alkoxycarbonyl group, or an aminoalkoxy group; and X represents one structure selected from the formulae (X1), (X2), and (X3):

(X1)

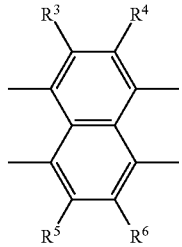

(X2)

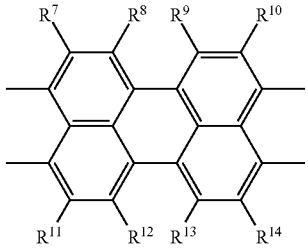

(X3)

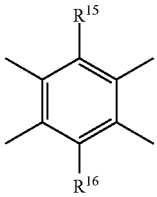

where $R^3$ to $R^{16}$ each independently represent a hydrogen atom, a halogen atom, a cyano group, a nitro group, a substituted or unsubstituted alkyl group having 1 to 6 carbon atoms in a main chain thereof, or a substituted or unsubstituted aryl group.

7. An electrophotographic apparatus, comprising:

an electrophotographic photosensitive member;

a charging unit;

an exposing unit;

a developing unit; and a transferring unit, the electrophotographic photosensitive member comprising:

a support;

an intermediate layer formed on the support, the intermediate layer containing a polymerized product of a composition containing a compound represented by formula (1);

a charge generating layer formed directly on the intermediate layer, the charge generating layer containing a phthalocyanine pigment and a resin; and a charge transporting layer formed on the charge generating layer, wherein when an averaged sectional difference of elevation in a calculated length range of from 0.1 to 100 μm in a surface of the intermediate layer on a charge generating layer side is measured, in a calculated length range of from 0.5 to 1.5 times of a calculated length at which a maximum of the averaged sectional difference of elevation (Rmk,max) is expressed, a value for the averaged sectional difference of elevation (Rmk) is 0.05 μm or more, where the averaged sectional difference of elevation Rmk is calculated by obtaining three-dimensional surface profile data z(x,y) on the intermediate layer by measuring vertical direction elevation data z(x,y) corresponding to horizontal direction coordinates (x,y), (1) dividing the resultant surface profile data into meshes each having a length of one side of L, (2) averaging the elevations z(x,y) in each mesh having a length of one side of L, (3) calculating in each mesh sectional differences of elevation from differences of elevation from the surrounding meshes, and (4) averaging the resultant sectional differences of elevation over all the meshes, with the resultant value being Rmk (1)

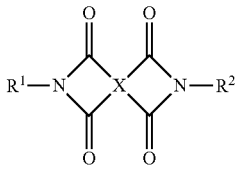

$R^1$ represents (i) an alkyl group having 1 to 6 carbon atoms in a main chain thereof, the alkyl group having 2 or more polymerizable functional groups, (ii) a group derived by substituting at least one $CH_2$ in a main chain of an alkyl group having 3 to 6 carbon atoms in the main chain, the alkyl group having 2 or more polymerizable functional groups, with an oxygen atom, or (iii) a group derived by substituting at least one $CH_2$ in a main chain of an alkyl group having 3 to 6 carbon atoms in the main chain, the alkyl group having 2 or more polymerizable functional groups, with $NR^{17}$, the polymerizable functional groups each comprise a hydroxy group, a thiol group, an amino group, or a carboxyl group, and $R^{17}$ represents a hydrogen atom or an alkyl group having 1 to 4 carbon atoms in a main chain thereof;

$R^2$ represents (i) a substituted or unsubstituted alkyl group having 1 to 6 carbon atoms in a main chain thereof, (ii) a group derived by substituting at least one $CH_2$ in a main chain of a substituted or unsubstituted alkyl group having 3 to 6 carbon atoms in the main chain with an oxygen atom, (iii) a group derived by substituting at least one $CH_2$ in a main chain of a substituted or unsubstituted alkyl group having 3 to 6 carbon atoms in the main chain with $NR^{18}$, (iv) a group derived by substituting at least one $C_2H_4$ in a main chain of a substituted or unsubstituted alkyl group having 3 to 6 carbon atoms in the main chain with COO, or (v) a substituted aryl group, and $R^{18}$ represents a hydrogen atom or an alkyl group having 1 to 4 carbon atoms in a main chain thereof;

the substituent comprises an alkyl group having 1 to 5 carbon atoms, a benzyl group, an alkoxycarbonyl group, or a phenyl group for each of the alkyl group, the group derived by substituting at least one $CH_2$ in the main chain of the alkyl group with an oxygen atom, the group derived by substituting at least one $CH_2$ in the main chain of the alkyl group with $NR^{17}$, the group derived by substituting at least one $CH_2$ in the main chain of the alkyl group with $NR^{18}$, and the group derived by substituting at least one $C_2H_4$ in the main chain of the alkyl group with COO;

the substituent of the aryl group comprises a halogen atom, a cyano group, a nitro group, a methyl group, an ethyl group, an isopropyl group, a n-propyl group, a n-butyl group, an acyl group, an alkoxy group, an alkoxycarbonyl group, or an aminoalkoxy group; and X represents one structure selected from the formulae (X1), (X2), and (X3):

(X1)

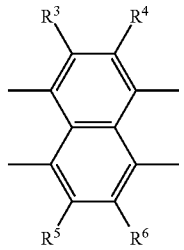

(X2)

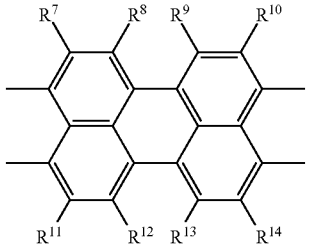

(X3)

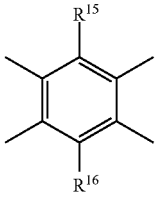

where $R^3$ to $R^{16}$ each independently represent a hydrogen atom, a halogen atom, a cyano group, a nitro group, a substituted or unsubstituted alkyl group having 1 to 6 carbon atoms in a main chain thereof, or a substituted or unsubstituted aryl group.

* * * * *